US006778148B1

(12) United States Patent
Pack

(10) Patent No.: US 6,778,148 B1
(45) Date of Patent: Aug. 17, 2004

(54) SENSOR ARRAY FOR ENHANCED DIRECTIVITY

(75) Inventor: James D. Pack, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/314,488

(22) Filed: Dec. 4, 2002

(51) Int. Cl.[7] ..... H01Q 1/36
(52) U.S. Cl. ..... 343/895; 343/844; 343/853
(58) Field of Search ..... 343/700 MS, 844, 343/853, 893, 895

(56) References Cited

U.S. PATENT DOCUMENTS 4,221,748 A 9/1980 Pasco et al.
4,339,648 A 7/1982 Jean
4,639,733 A 1/1987 King et al.
6,300,918 B1 * 10/2001 Riddle et al. ..... 343/895
6,433,754 B1 * 8/2002 Boeringer ..... 343/893
6,456,244 B1 * 9/2002 Goldstein et al. .... 343/700 MS
6,646,621 B1 * 11/2003 Phelan et al. ..... 343/895
2002/0140615 A1 10/2002 Carles et al.

* cited by examiner

*Primary Examiner*—Tho Phan
(74) *Attorney, Agent, or Firm*—Allan Y. Lee; Michael A. Kagan; Peter A. Lipovsky

(57) ABSTRACT

A planar sensor array described herein as a spiral lattice planar array is comprised of a plurality of sets of sensor elements wherein for each set of the sensor elements an element is disposed at a vertex of an equilateral non-equiangular pentagon. One embodiment includes a plurality of sets of the pentagon arranged elements in an annular array configuration having a centrally located open center defined by the annular array. Another embodiment includes a plurality of sets of the pentagon arranged elements in a core configuration. The core configuration can be disposed within the open center of the annular array configuration. All sensor elements are confined to a single plane. The sensor elements can be equally weighted or may be weighted to provide side-lobe adjustment.

15 Claims, 35 Drawing Sheets

SQUARE ARRAY

SQUARE ARRAY

SQUARE ARRAY

SQUARE ARRAY

HEXAGONAL ARRAY

HEXAGONAL ARRAY

HEXAGONAL ARRAY

HEXAGONAL ARRAY

HEXAGONAL ARRAY

Spiral Lattice Array

Spiral Lattice Array

SPACE FACTOR OF THE ARRAY

SPACE FACTOR OF THE ARRAY

SPACE FACTOR OF THE ARRAY

SPACE FACTOR OF THE ARRAY

SPACE FACTOR OF THE ARRAY

SPACE FACTOR OF THE ARRAY

SPACE FACTOR OF THE ARRAY

SPACE FACTOR OF THE ARRAY

SPACE FACTOR OF THE ARRAY

SPACE FACTOR OF THE ARRAY

SENSOR ARRAY FOR ENHANCED DIRECTIVITY

BACKGROUND OF THE INVENTION

Antennas can be placed in arrays to improve directionality or achieve other desired receiving or transmitting characteristics. Many types of arrays have been studied and constructed: the line array; the square lattice planar array; the hexagonal lattice planar array; the ring array; and even random planar arrays. Volumetric (three-dimensional) arrays are also possible and, of course, have three-dimensional frequency response characteristics.

The directionality characteristics of certain antenna are well known. It is known that specific arrays of antennas can be used to increase a response in certain desired directions while suppressing responses from other directions. An antenna array having high directivity will have a minimum of undesired side-lobes and grating lobes. Side-lobes are generally considered to be an undesirable consequence of forming beams through certain antenna arrays. Grating lobes are a type of side-lobe that replicate a maximum response of an array. If not known or accounted for, grating lobes can provide misleading information as to the direction of a received signal. Side-lobe and grating lobe suppression is often attempted through selective weighting of certain antenna inputs of an antenna array. This suppression is also attempted through geometric means, such as by particularly spacing and arranging array sensors with respect to each other.

Many types of square lattice planar arrays are known to the art. Shown in FIGS. 1–4 are four examples of these. Diamond symbols are used to indicate sensor location in these figures and those that follow. The array spacing is denoted by the distance a. In these arrays, as well as the arrays to be described further in this description, terminology taken from crystallography is used to describe certain array features. A source of such terminology is: *Transformation Geometry: An Introduction to Symmetry*, by Martin, George Edward, Springer-Verlag, New York, 1982.

Using this descriptive language, the square lattice planar array has four-fold rotational symmetry and also has four mirror symmetry planes. Arrays of various orders can be constructed. In general, an nth order square array contains $(2n+1)\times(2n+1)$ points. An array of order zero is a single point. An array of order one has nine points arranged in a $3\times3$ pattern as shown in FIG. 1. FIG. 2 shows a second order square array containing 25 points. FIG. 3 shows a third order square array containing 49 points. FIG. 4 is an array of order four.

Hexagonal arrays are depicted in FIGS. 5–9, wherein diamonds again depict sensor position. Array spacing is again a. The hexagonal array has six-fold rotational symmetry and also has six mirror symmetry planes. Arrays of various orders can be constructed. In general, an nth order hexagonal array contains $1+3n(n+1)$ points. An array of order zero is a single point. Referring to FIG. 5, an array of order one has six points equally spaced at a distance a from a central point. The total number of points in the array of order one is seven. FIG. 6 shows an array of order two having twelve additional points for a total of 19 points. FIG. 7 shows a third order hexagonal array containing a total of 37 points. FIGS. 8 and 9 show respectively fourth and fifth order hexagonal arrays.

A ring array consists of N elements equally spaced on the circumference of a circle. The array has N-fold rotational symmetry and N mirror symmetry elements. FIG. 10 shows a configuration of a ring planar array containing six elements. FIG. 11 illustrates a ring array with 18 elements. Ring arrays have proven useful in direction finding applications.

While a great deal of research has been conducted in the field of planar arrays, there is still a need for a planar array configuration that has enhanced directivity and minimal undesired grating and side-lobes.

SUMMARY OF THE INVENTION

A planar sensor array described herein as a spiral lattice planar array is comprised of a plurality of sets of sensor elements wherein for each set of the sensor elements an element is disposed at a vertex of an equilateral non-equiangular pentagon. One embodiment includes a plurality of sets of the pentagon arranged elements in an annular array configuration having a centrally located open center defined by the annular array. Another embodiment includes a plurality of sets of the pentagon arranged elements in a core configuration. The core configuration can be disposed within the open center of the annular array configuration. All sensor elements are confined to a single plane. The sensor elements can be equally weighted or may be weighted to provide side-lobe adjustment.

An object of this invention is to provide a sensor array that has enhanced directivity.

A further object of this invention is to provide a sensor array that minimizes undesired side-lobes.

Still a further object of the invention is to provide a sensor array that minimizes undesired grating lobes.

Still yet another object of this invention is to provide a planar sensor array that utilizes array geometry to minimize undesired side-lobes and grating lobes and that provides desired directivity.

Other objects, advantages and new features of the invention will become apparent from the following detailed description when considered in conjunction with the accompanied drawings.

DESCRIPTION

A planar sensor array includes at least one set of sensor elements wherein for each set of the sensor elements an element is disposed at a vertex of an equilateral non-equiangular pentagon. One embodiment includes a plurality of sets of the pentagon arranged elements in an annular array configuration having a centrally located open center defined by the annular array. This embodiment is described generally herein as a spiral lattice planar array. Another embodiment includes a plurality of sets of the pentagon arranged elements in a core configuration. The core configuration can be disposed within the open center of the annular array configuration in what is described herein as an augmented spiral lattice array. The combination of configurations is described generally herein as an augmented spiral lattice planar array. All sensor elements are confined to a single plane. The sensor elements can be equally weighted or may be weighted to provide side-lobe adjustment. The following description uses weights that are all equal.

Figure 12:
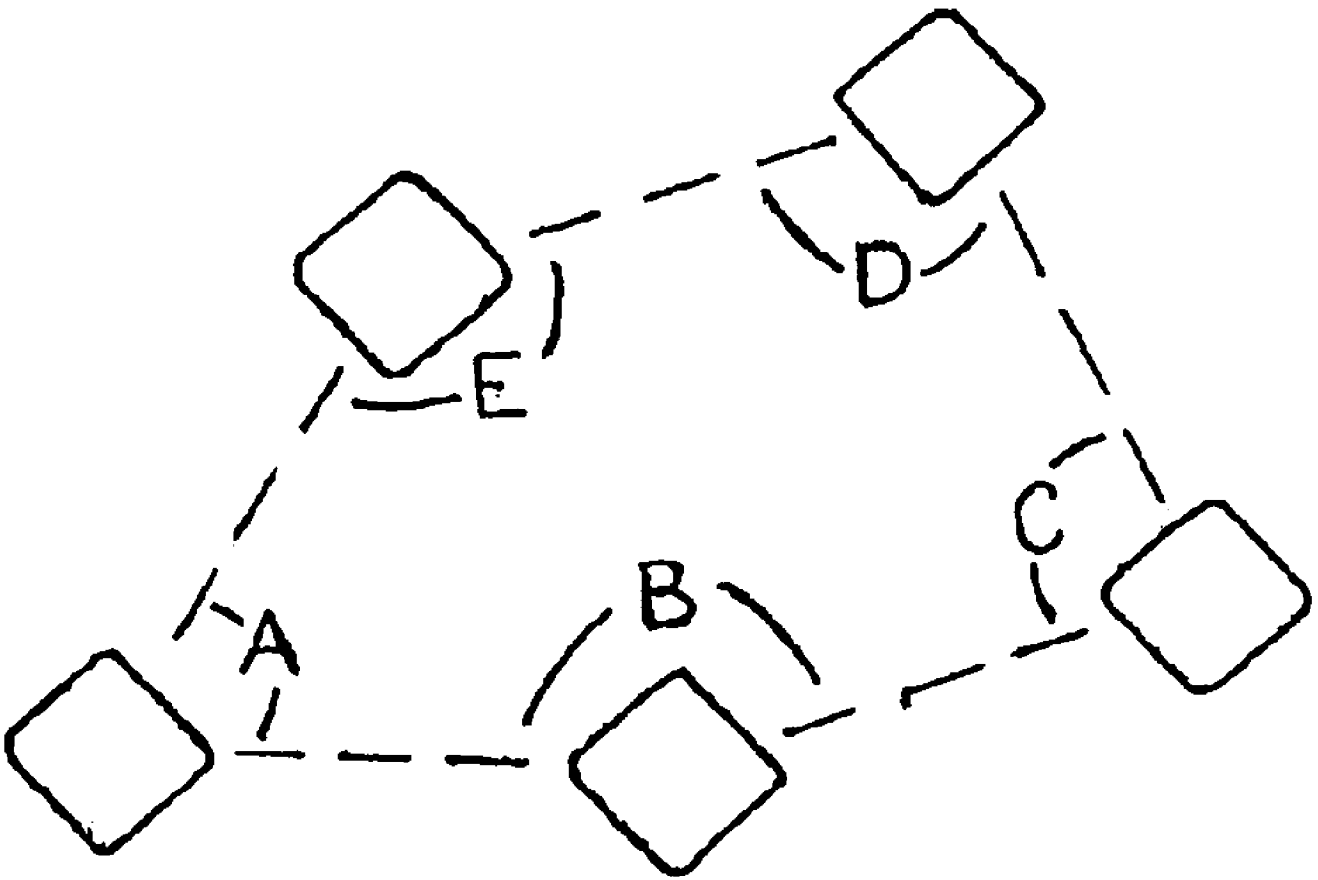
FIG. 12 illustrates a pentagon shaped configuration comprising a set of five sensor elements.

A set of five sensor elements are positioned using the vertices of an equilateral pentagon whose interior angles are 60, 160, 80, 100, and 140 degrees, respectively. FIG. 12 depicts a pentagon shape made by connecting, with imaginary lines, a set of five sensor elements so disposed. In this figure, angle A is 60 degrees, angle B is 160 degrees, angle C is 80 degrees, angle D is 100 degrees and angle E is 140 degrees.

Figure 13:
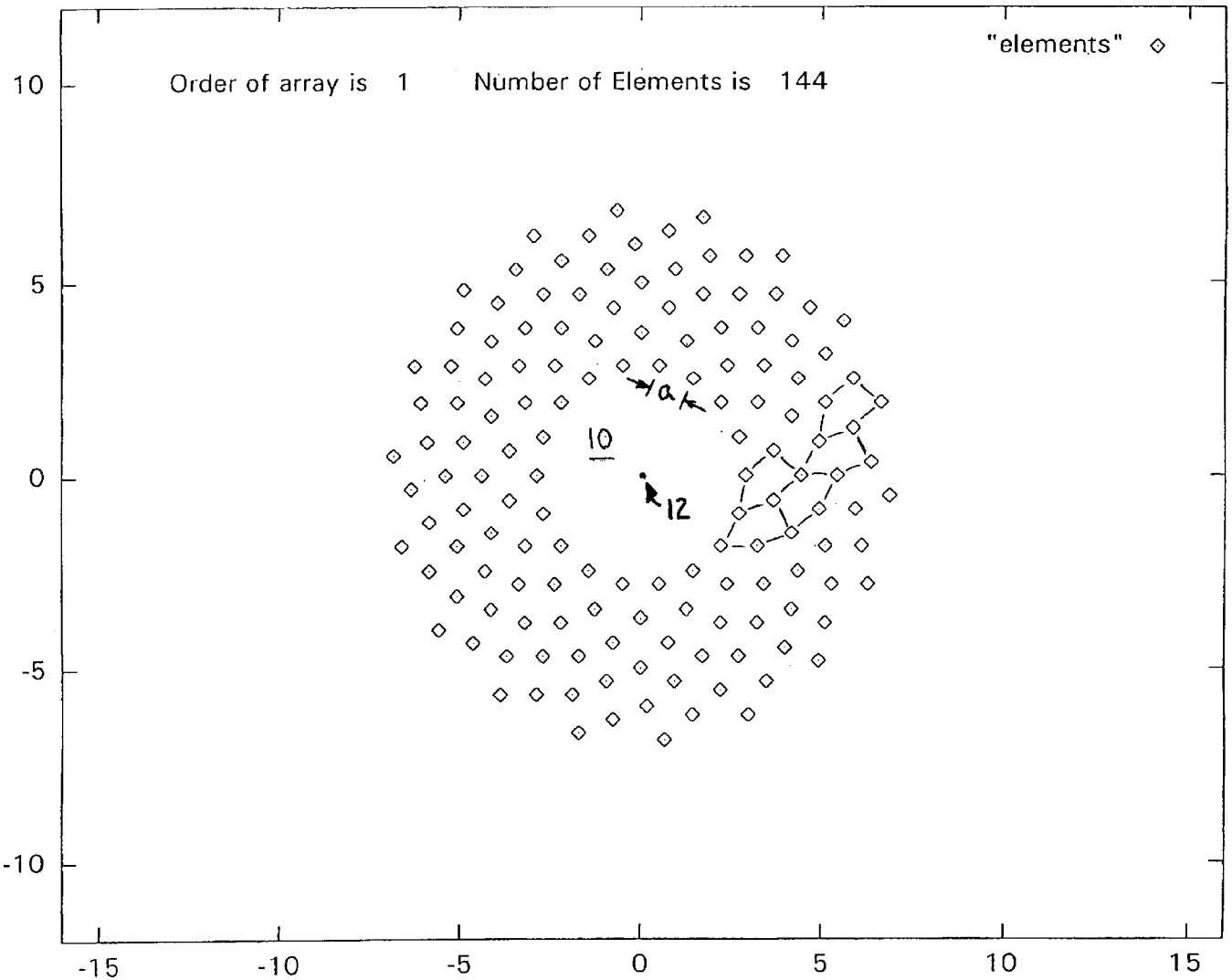
FIG. 13 illustrates an annular configuration of a spiral lattice array of order one.
Figure 14:
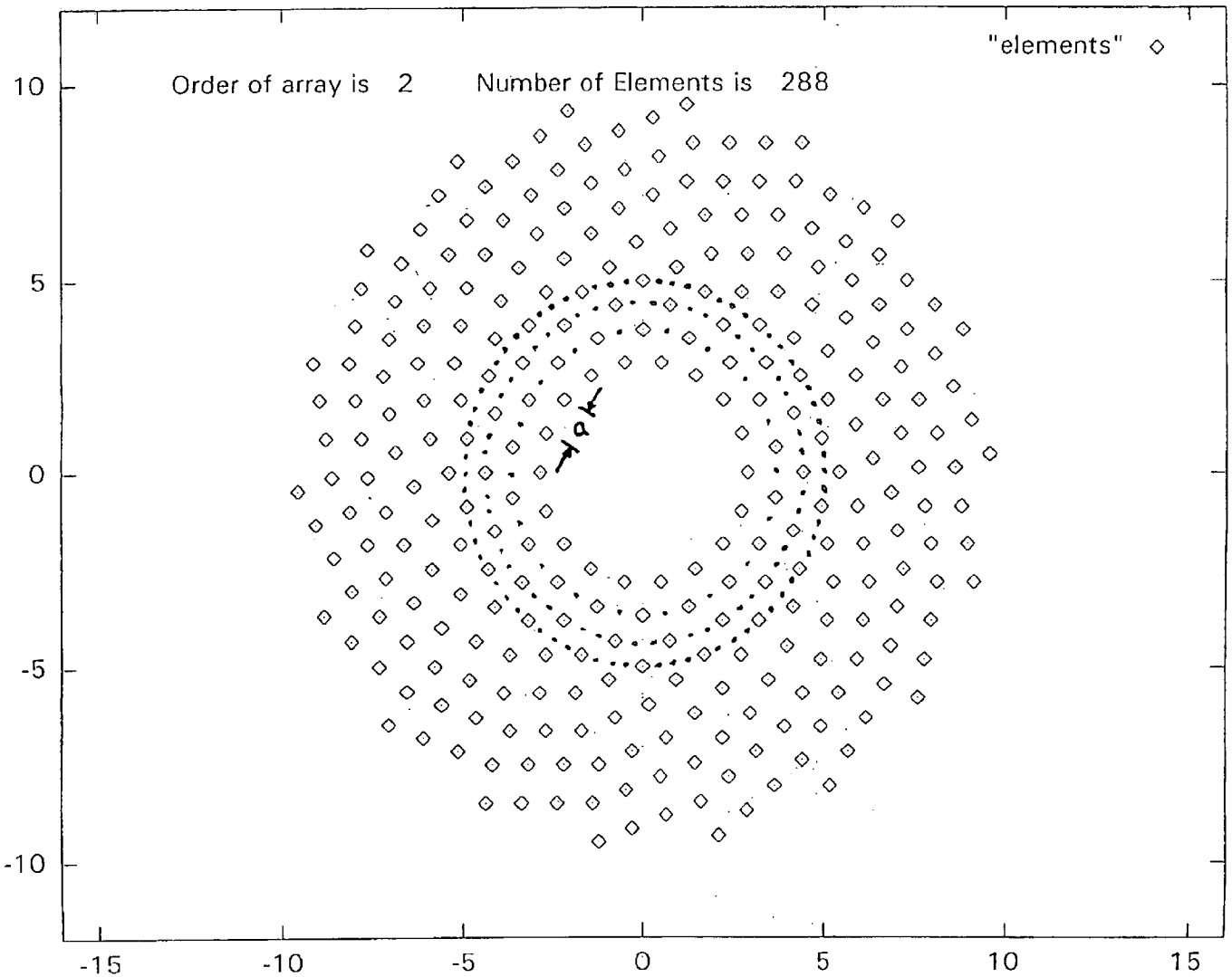
FIG. 14 illustrates an annular configuration of a spiral lattice array of order two.
Figure 15:
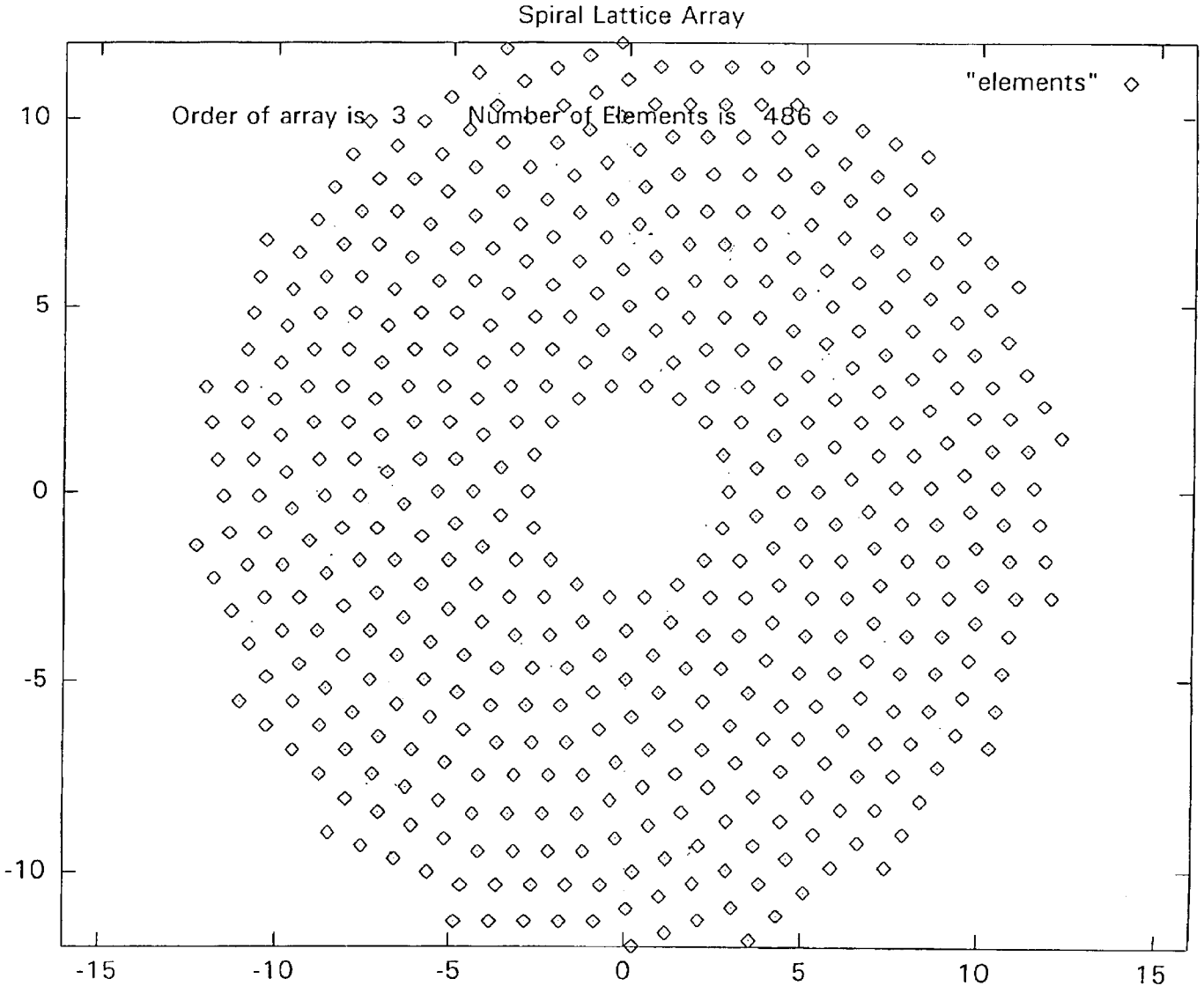
FIG. 15 illustrates an annular configuration of a spiral lattice array of order three.

Arrays each using a plurality of these pentagon-shaped sets of sensor elements are depicted in FIGS. 13–15. In these arrays, nearest neighbor elements are separated by a distance a as chosen by a user. "Outlines" of several pentagon-shaped sets of sensors are shown in FIG. 13. The array shown defines a centrally located open center 10 having central point 12.

The sensor arrays of FIGS. 13–15 have the interesting property of a maximum frequency response occurring only at k (vector)=0. There are no translation vectors in K space such that $F(k)=F(k+k_0)$. The points in FIGS. 13, 14, and 15 are arranged in a pattern that posses eighteen-fold rotational symmetry.

FIG. 13 shows a first order 18-fold symmetric array. It contains 144 elements. FIG. 14 depicts a second order 18-fold symmetric array containing 288 elements. FIG. 15 depicts a third order 18-fold symmetric array containing 486 elements.

Figure 16:
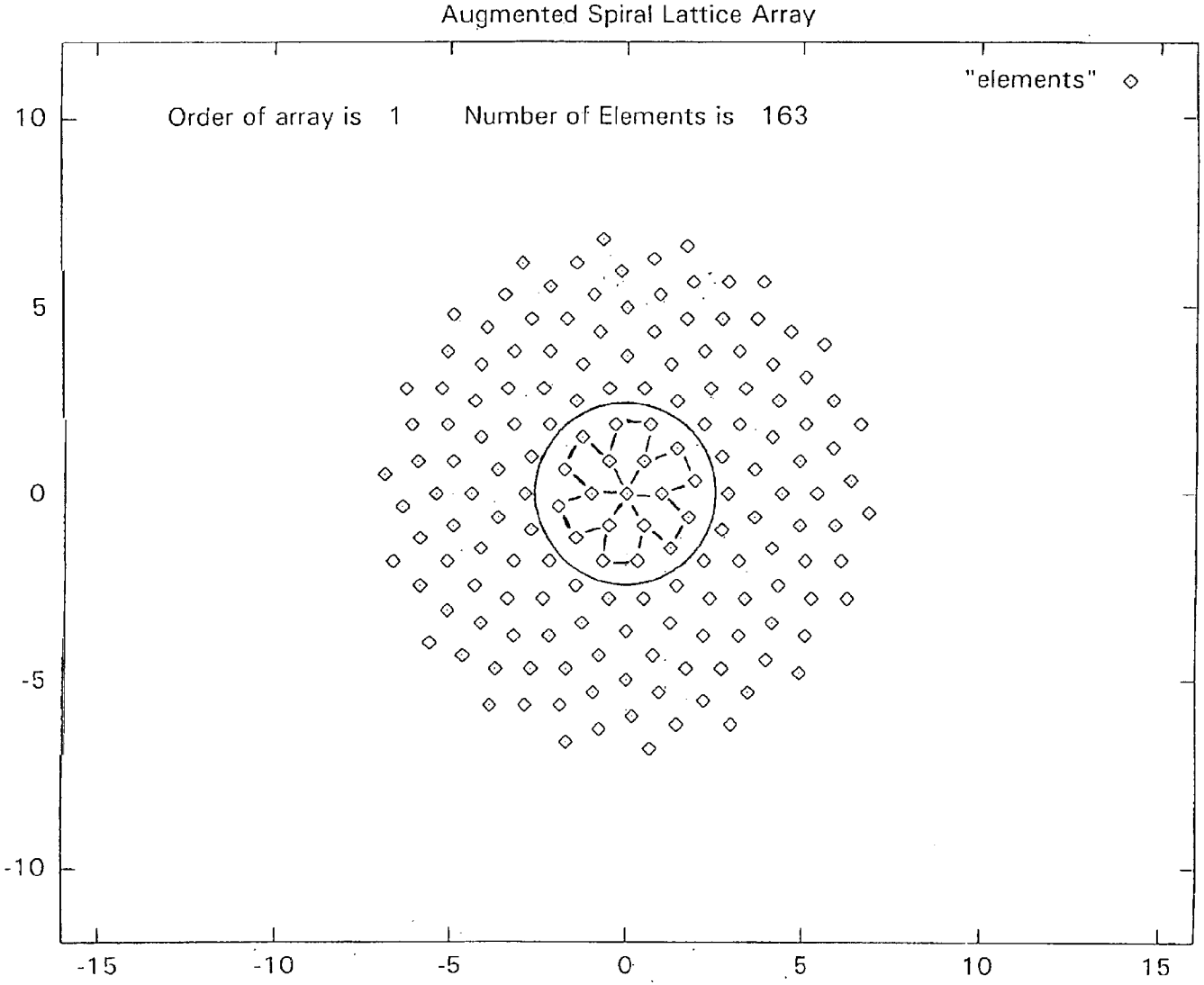
FIG. 16 illustrates an augmented annular configuration of a spiral lattice array of order one.

In FIG. 16, another array embodiment that can also be constructed using these same equilateral, non-equiangular pentagons is shown. It is identical to the pattern in FIG. 13 except that the centrally located open center region 10 of FIG. 13 has been filled with a core configuration of an additional 19 sensor elements, located at the vertices of the afore-described equilateral pentagons. The core configuration array is shown encircled in FIG. 16 and has six-fold rotational symmetry and elements that arc offset from the elements of the annular configuration by the same nearest neighbor distance of a. Outlines of several pentagon-shaped sets of sensors are also shown in FIG. 16 for this configuration. These two configurations of pluralities of sets of sensor elements are made co-planar. A more detailed geometric relationship of the elements of the embodiments of these arrays will be described later in this description.

The following presents a mathematical description which may be used to determine the performance of the planar spiral lattice array.

The distant field from the $i^{th}$ antenna element can be represented by:

$$E_i(\theta,\phi)=f(\theta,\phi)I_i\exp[j(k\bullet r_i+\alpha_i)]$$

Where $f(\theta,\phi)$ is the far-field function associated with the $i^{th}$ element, $\lambda$ is the wavelength, $r_i$ is a vector representing the position of the $i^{th}$ element, k is a vector whose direction is given by $\theta$ and $\phi$ and whose magnitude is $2\pi/\lambda$, $I_i$ is the amplitude excitation, $\alpha_i$ is the phase excitation, and j is the square root of (−1). Note that k•r is the dot product of the vectors k and r.

The total field contributed from all elements of the array can be obtained by taking the sum of each element:

$$E(\theta,\phi)=\Sigma f(\theta,\phi)I_i\exp[j(k\bullet r+\alpha_i)]$$

If all array elements are identical and similarly oriented then:

$$E(\theta,\phi)=f(\theta,\phi)S(k)$$

Where $S(k)=\Sigma I_i \exp[j(k \cdot r+\alpha_i)]$ and $\Sigma$ represents a summation over all i elements.

Since k is a vector S(k) is a function of $\theta$ and $\phi$ as well. The transformation from spherical to Cartesian coordinates is given by:

$$k_x=k \sin\theta \cos\phi$$

$$k_y=y \sin\theta \sin\phi$$

$$k_z=k \cos\theta \phi$$

If $k_p$ is defined to be: $k_p=k \sin\theta$ then $$k_x=k_p \cos\phi$$

$$k_y=k_p \sin\phi$$

The values of $\alpha_i$ can be chosen so as to orient the main lobe in the desired direction. This phased array can steer the main lobe of the array in any desired direction. If all values of $\alpha_i$ are zero then the main beam will be oriented in a direction perpendicular to the plane of the array.

S(k) is often called the space factor or array factor. It describes the directionality of the array. S(k) will now be calculated for the array configurations previously described.

Space factors, S(k), for the various array element configurations of FIGS. 1–11 and 13–18 are shown in FIGS. 19 through 35. The independent variable in these plots is ($k_p a$). It is also equal to ($ak \sin\theta$)=($2\pi a/\lambda \sin\theta$). In these figures, all sensor element weights are equal though one skilled in the art will realize that variation in element weights is possible.

Figure 30:
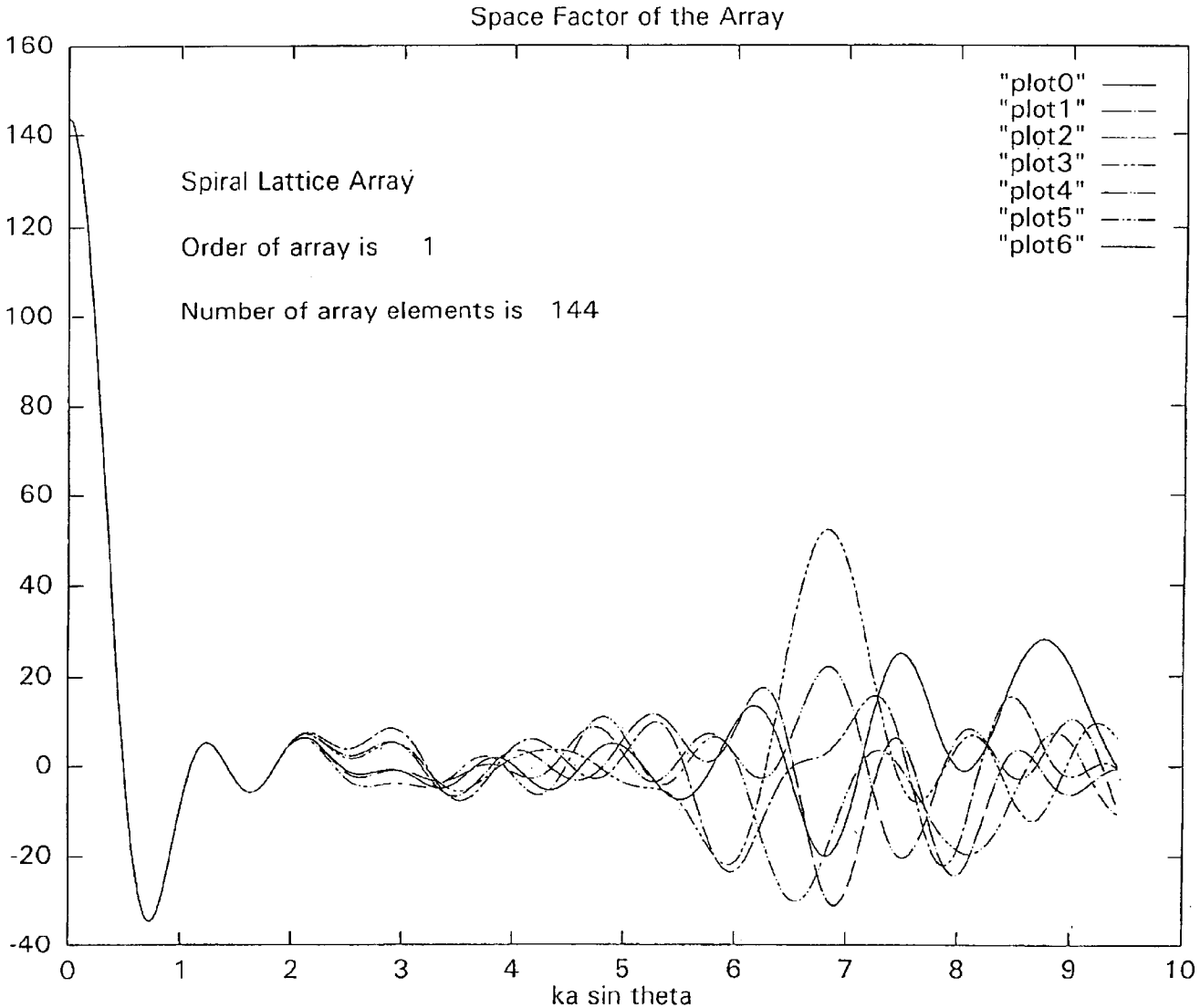
FIG. 30 shows space factors corresponding to the element configuration of FIG. 13.
Figure 31:
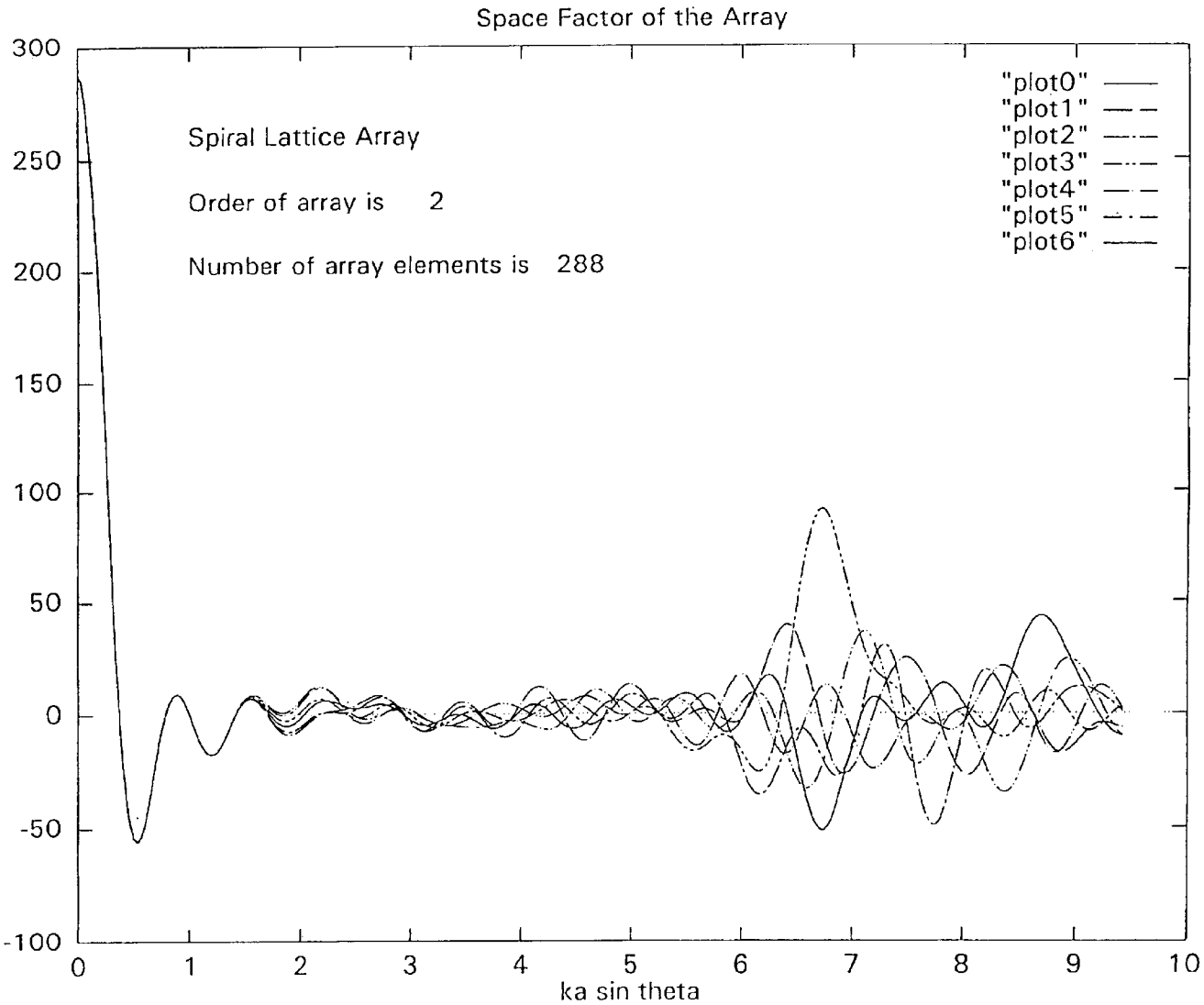
FIG. 31 shows space factors corresponding to the element configuration of FIG. 14.
Figure 32:
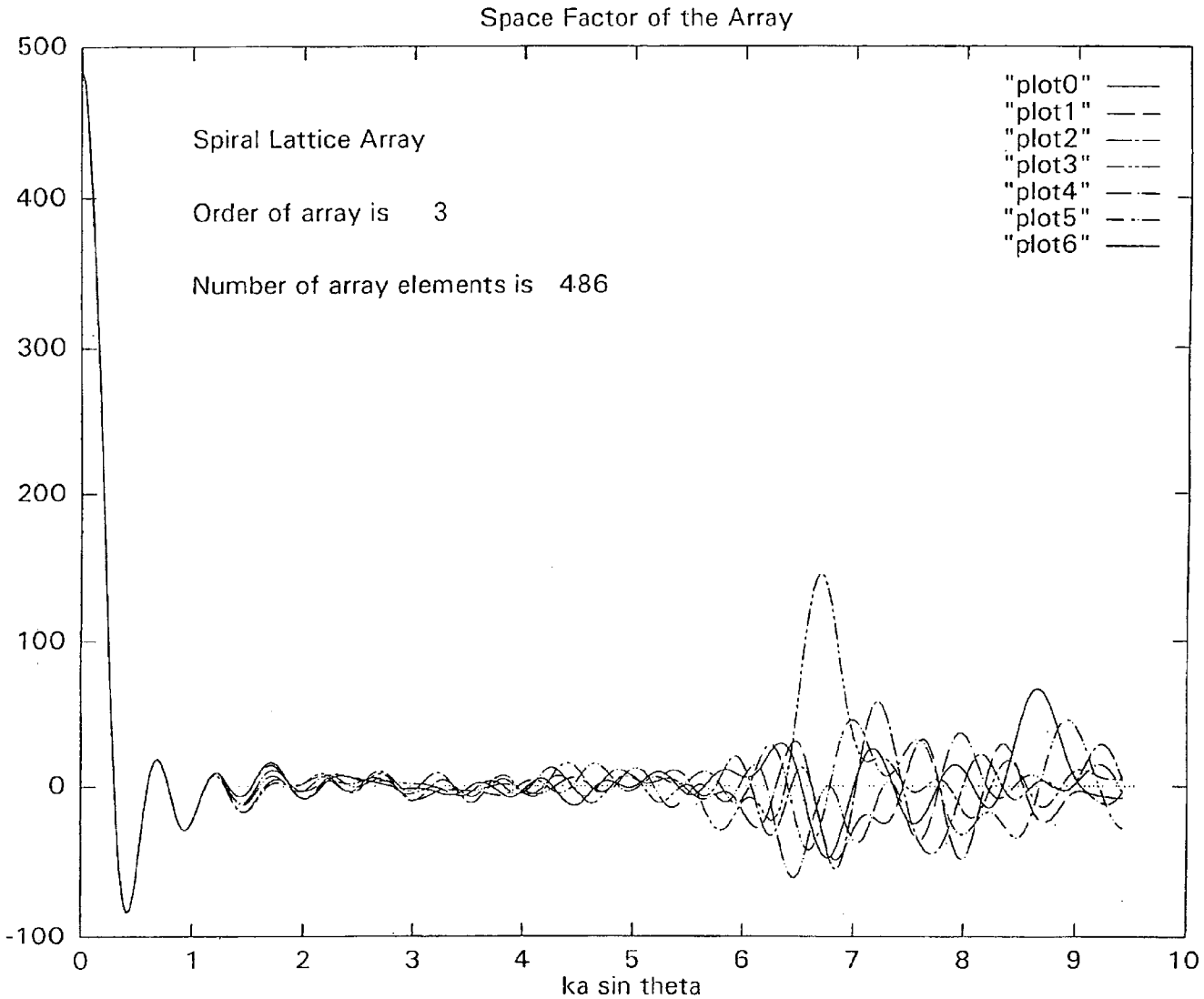
FIG. 32 shows space factors corresponding to the element configuration of FIG. 15.
Figure 33:
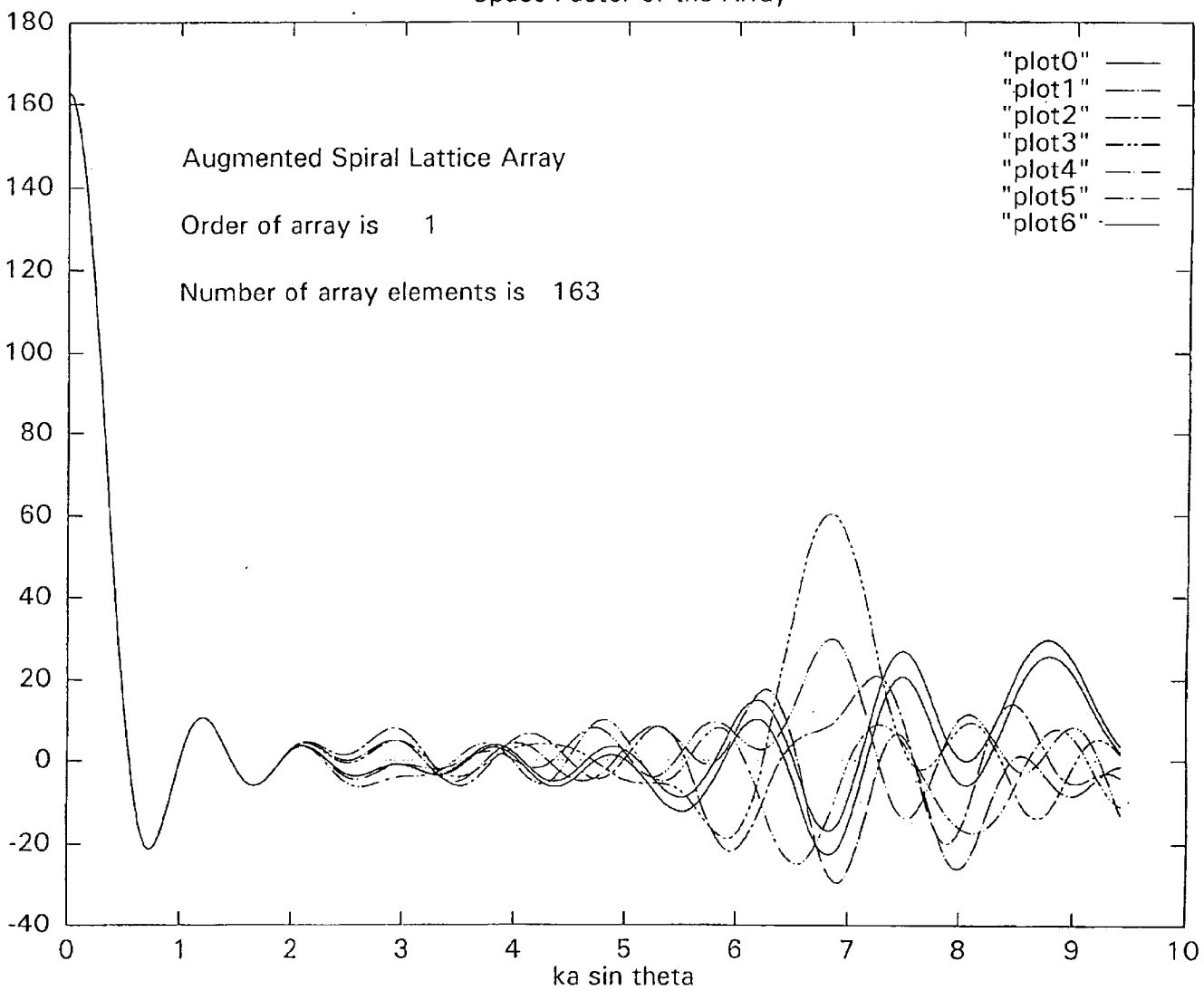
FIG. 33 shows space factors corresponding to the element configuration of FIG. 16.
Figure 34:
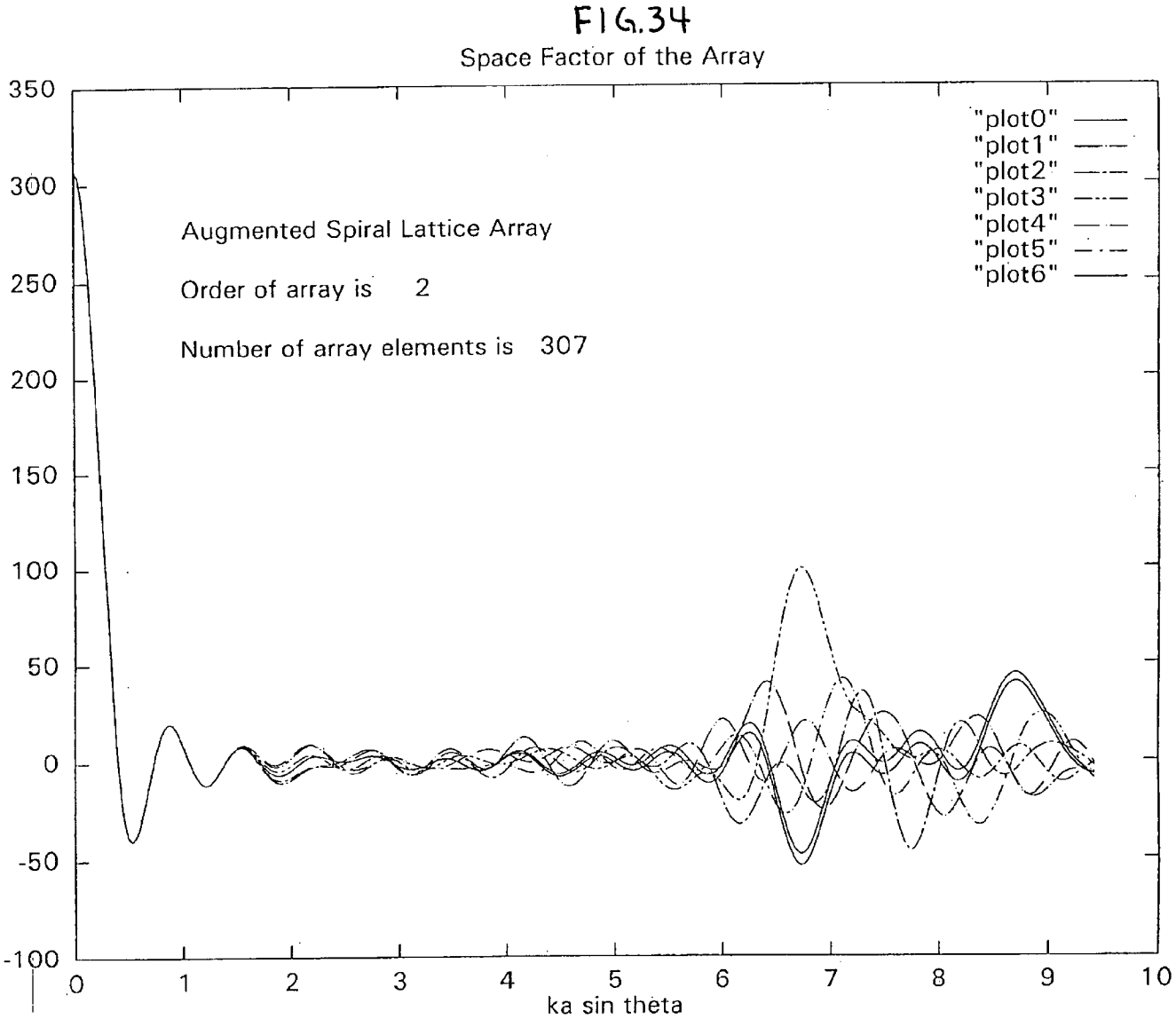
FIG. 34 shows space factors corresponding to the element configuration of FIG. 17.
Figure 35:
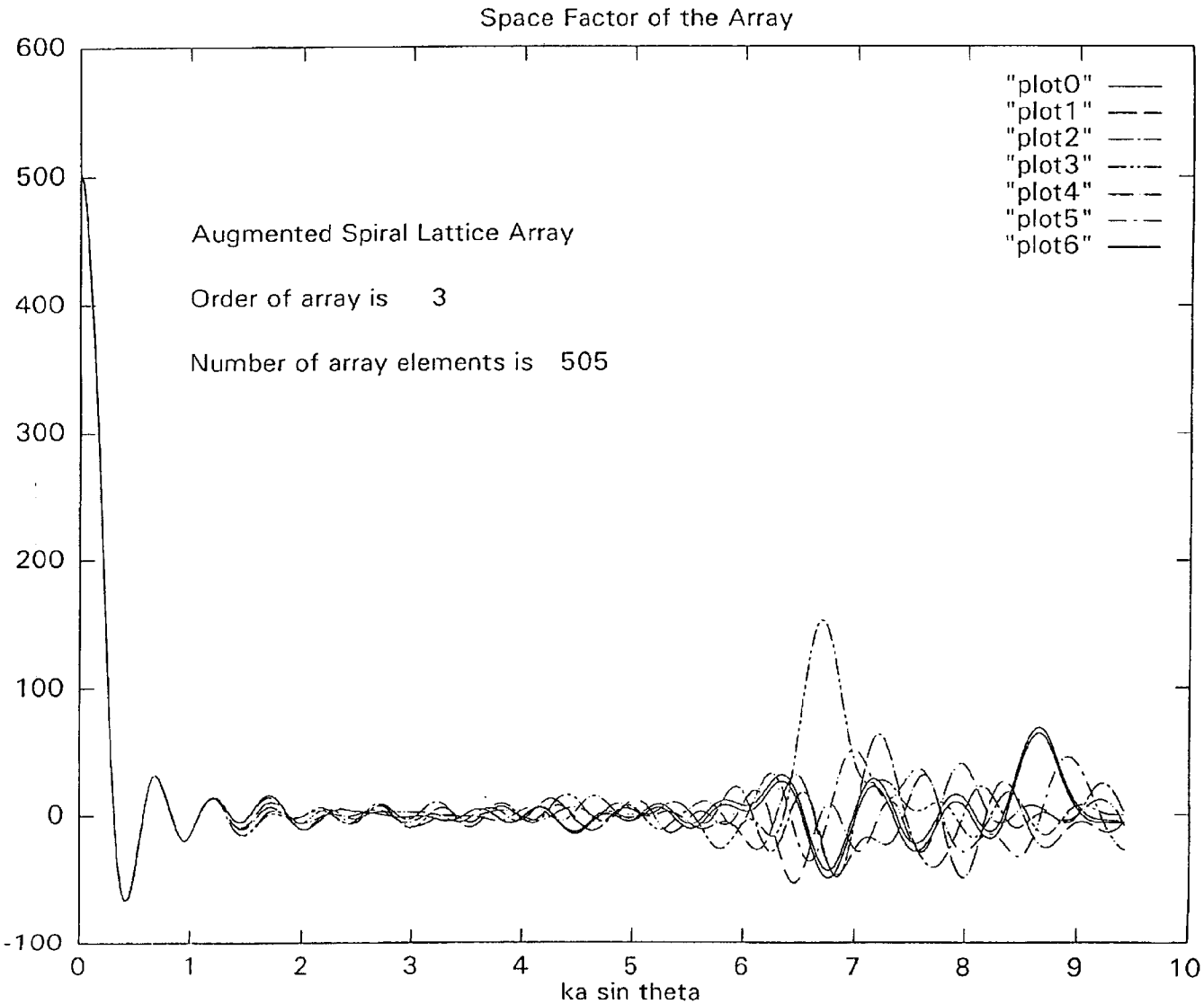
FIG. 35 shows space factors corresponding to the element configuration of FIG. 18.

FIGS. 19 through 22 depict space factors of square array configurations of order 1, 2, 3, and 4 respectively. FIGS. 23 through 27 depict space factors of hexagonal array configurations of orders 1, 2, 3, 4, and 5 respectively. FIG. 30 through 32 depict space factors of spiral lattice arrays of orders 1, 2, and 3, respectively. FIGS. 33 through 35 depict space factors of augmented spiral lattice arrays of orders 1, 2, and 3, respectively, (an annular configuration of pentagonal arranged sensor sets augmented by a core configuration of pentagonal arranged sets of elements).

Space Factors of Planar Arrays

If S(k) denotes the space factor or array factor then the following can be said for the following arrays:

Square Array

Figure 1:
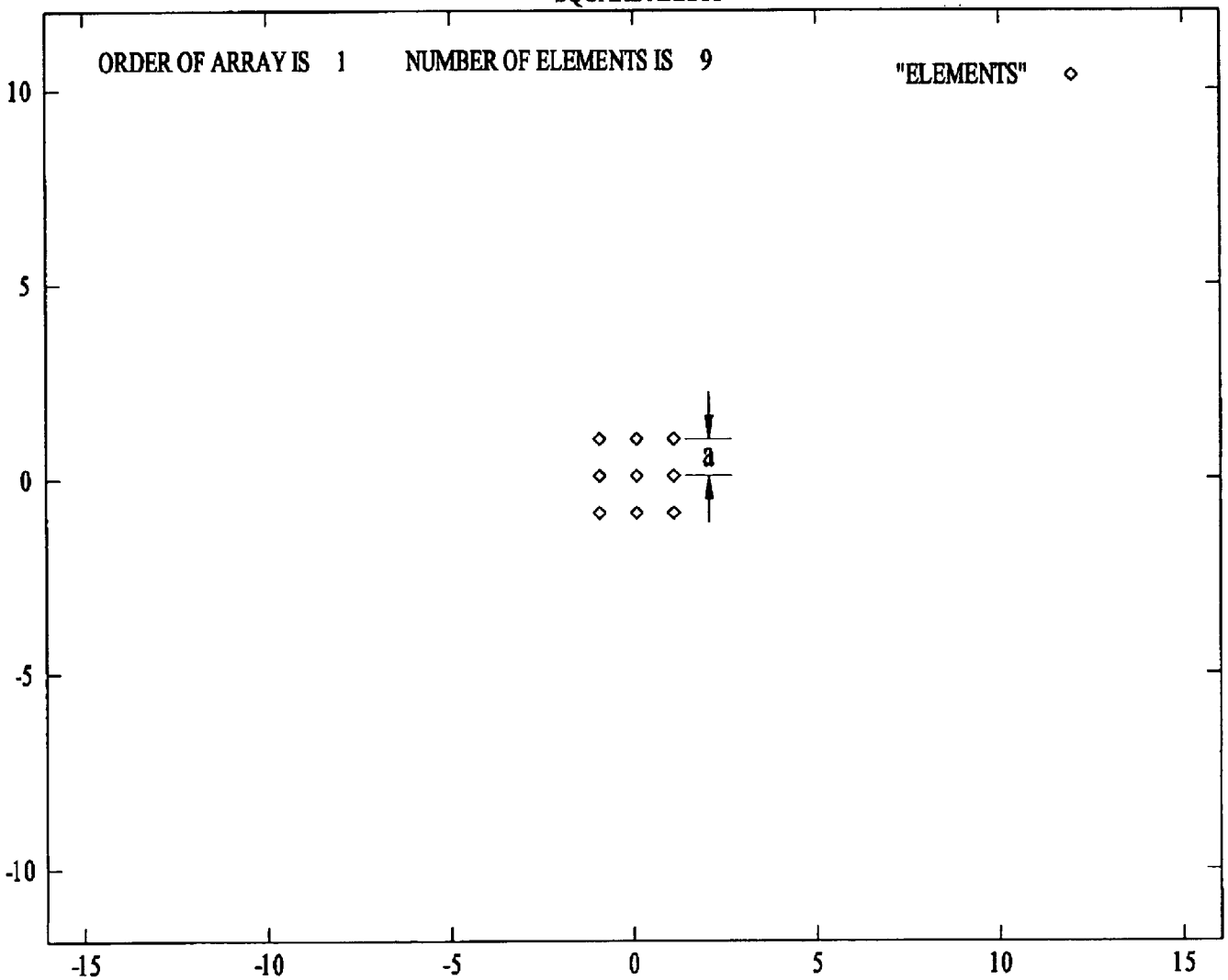
FIG. 1 (PRIOR ART)
FIG. 1 illustrates a first order square array of the prior art.
Figure 2:
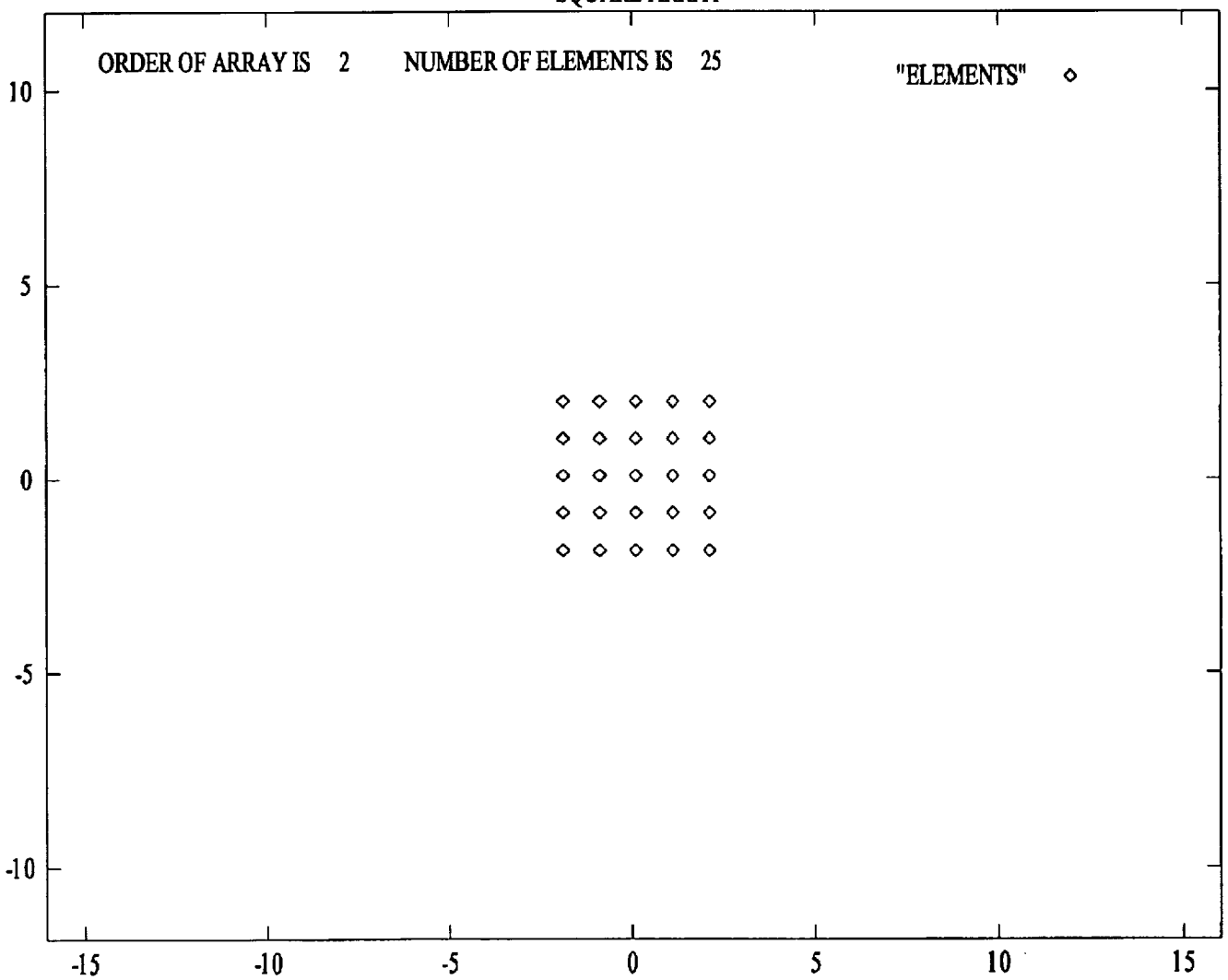
FIG. 2 (PRIOR ART)
FIG. 2 illustrates a second order square array of the prior art.
Figure 3:
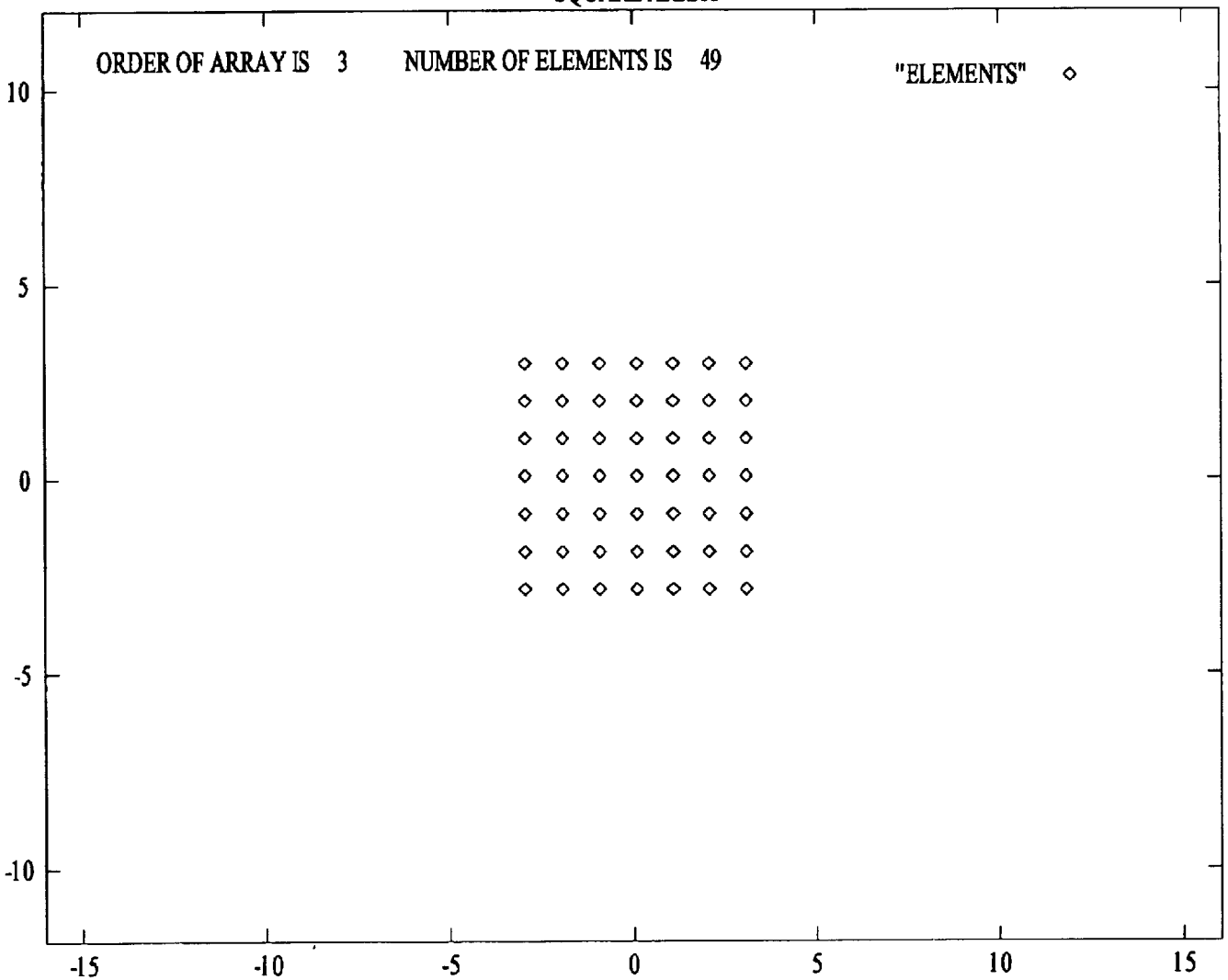
FIG. 3 (PRIOR ART)
FIG. 3 illustrates a third order square array of the prior art.
Figure 4:
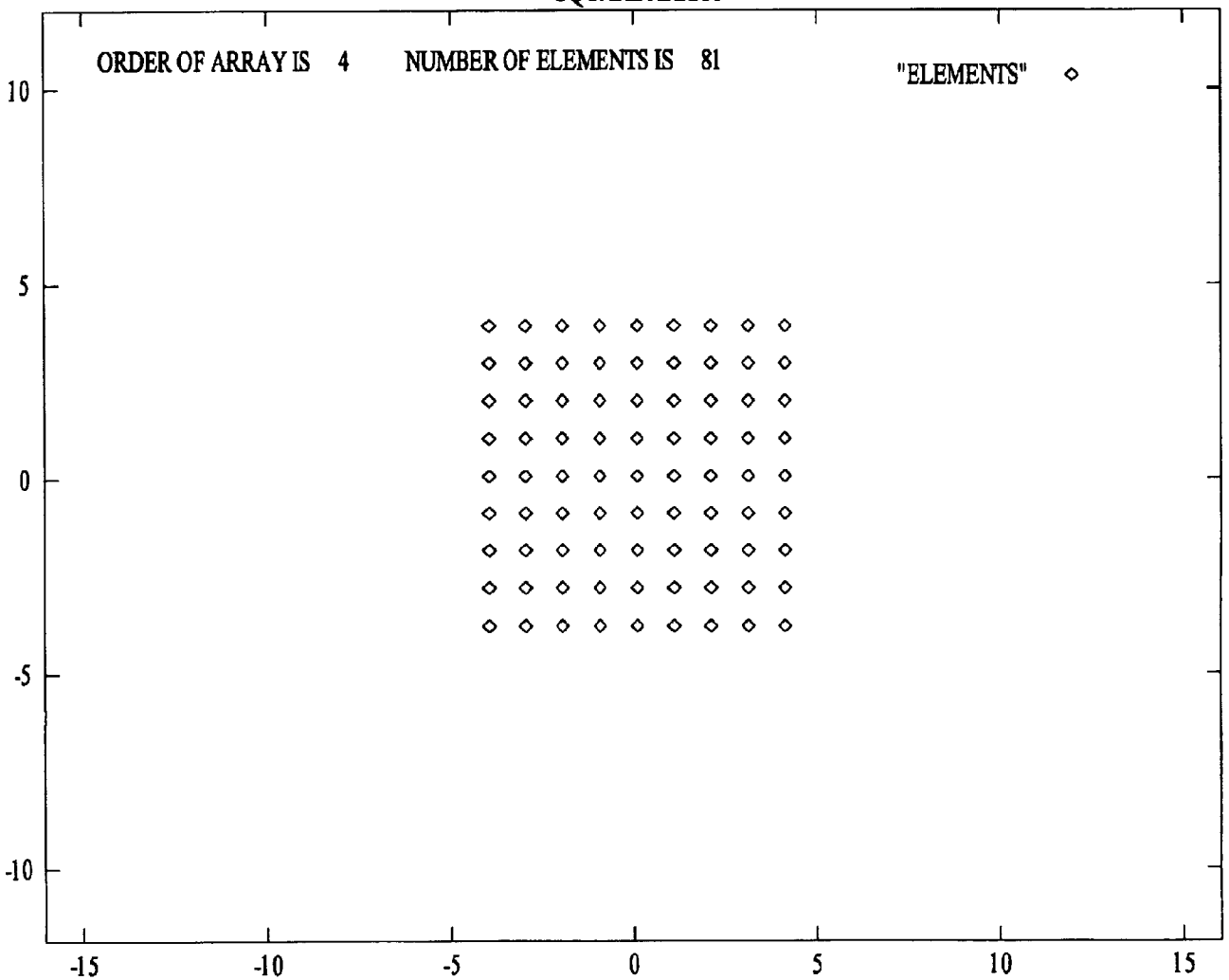
FIG. 4 (PRIOR ART)
FIG. 4 illustrates a fourth order square array of the prior art.
Figure 5:
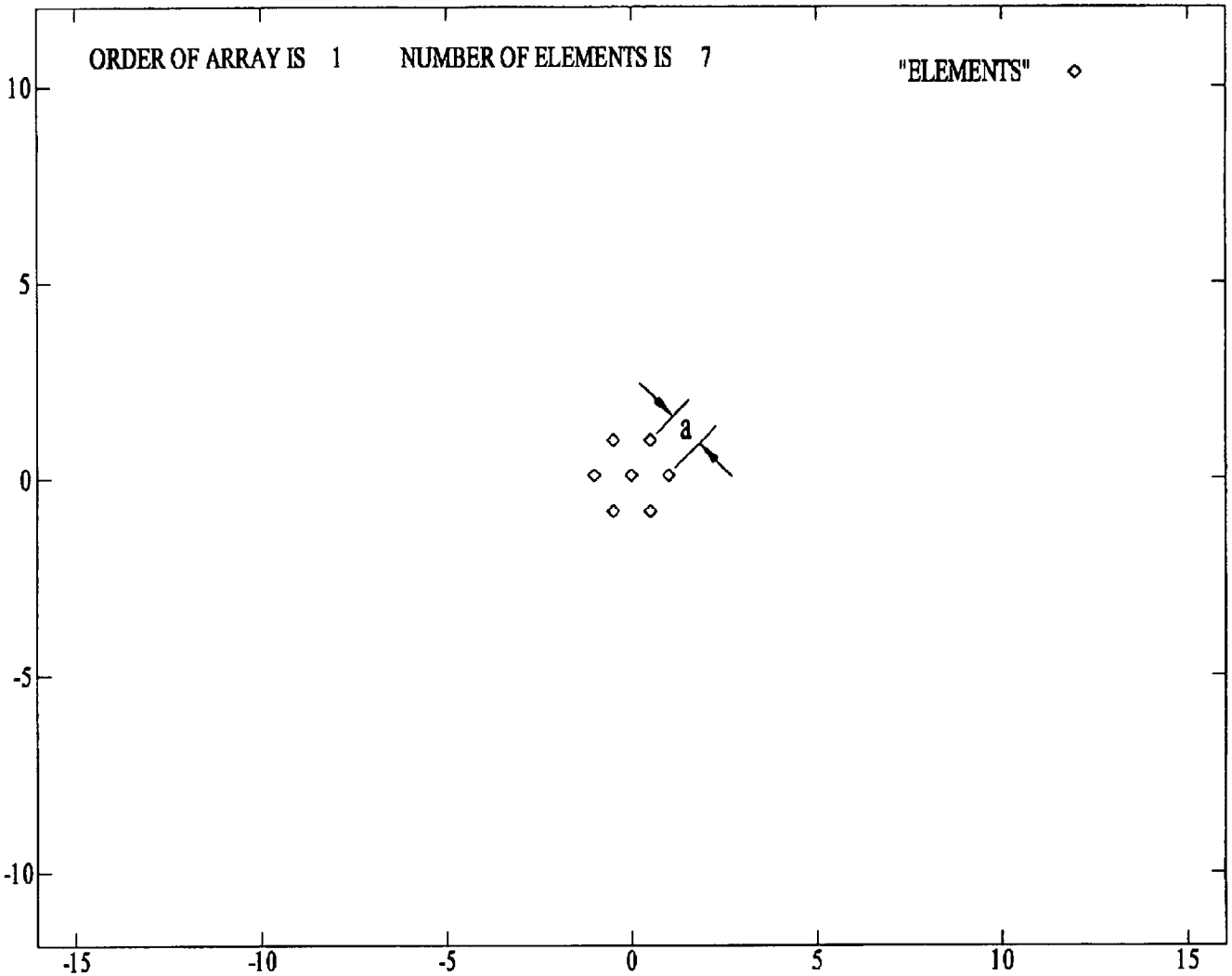
FIG. 5 (PRIOR ART)
FIG. 5 illustrates a first order hexagonal array of the prior art.
Figure 6:
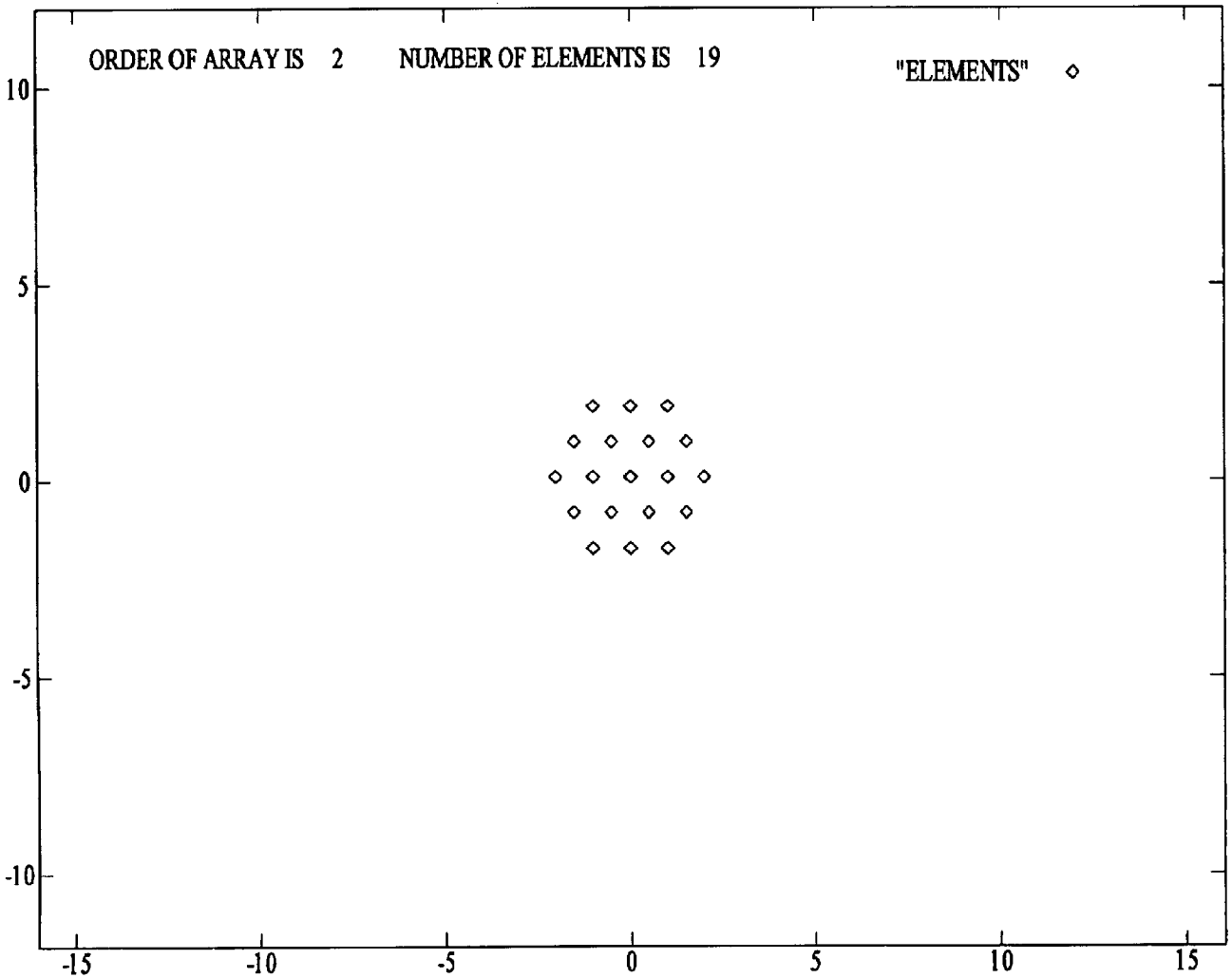
FIG. 6 (PRIOR ART)
FIG. 6 illustrates a second order hexagonal array of the prior art.
Figure 7:
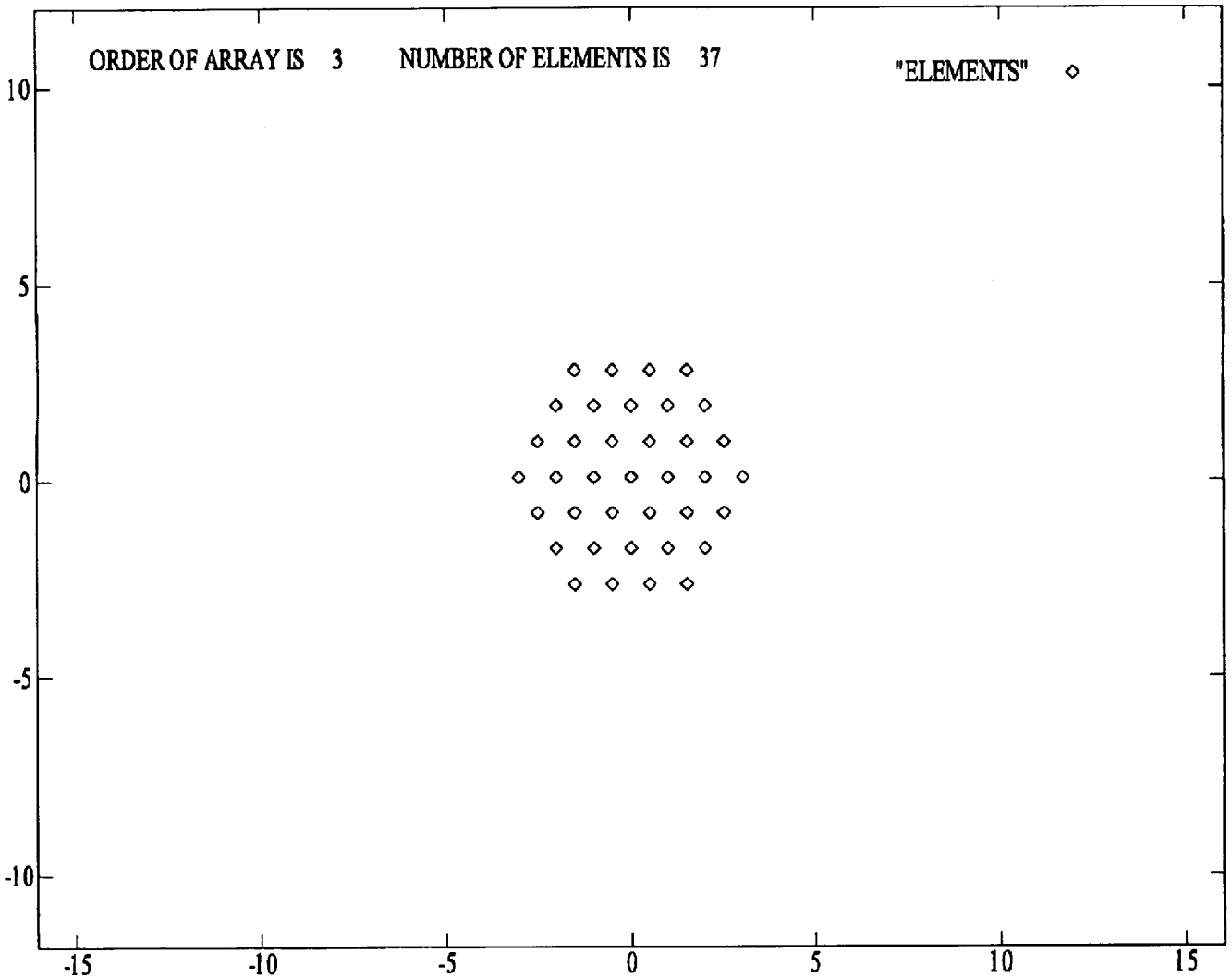
FIG. 7 (PRIOR ART)
FIG. 7 illustrates a third order hexagonal array of the prior art.
Figure 8:
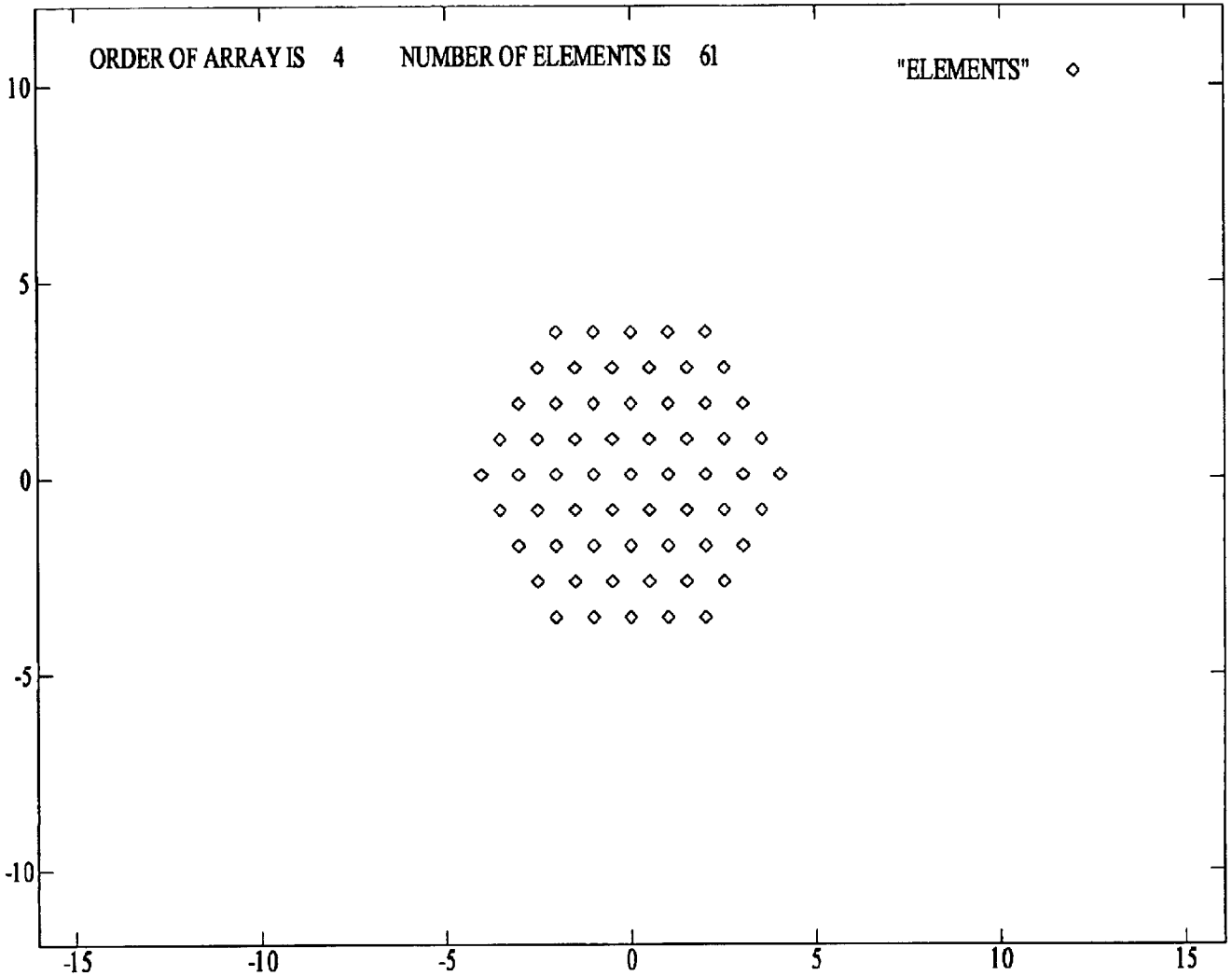
FIG. 8 (PRIOR ART)
FIG. 8 illustrates a fourth order hexagonal array of the prior art.

The square planar array depicted in FIG. 4 has four-fold rotational symmetry and four reflection planes. This symmetry is transformed into k space. The vector k can be represented by its spherical coordinate components, $S(k,\theta,\phi)$. The following symmetry properties apply for the Fourier transform of the square array.

$$S(k,\theta,\phi+\pi/2)=S(k,\theta,\phi)$$

$$S(k,\theta,-\phi)=S(k,\theta,\phi)$$

Hexagonal Array

Figure 9:
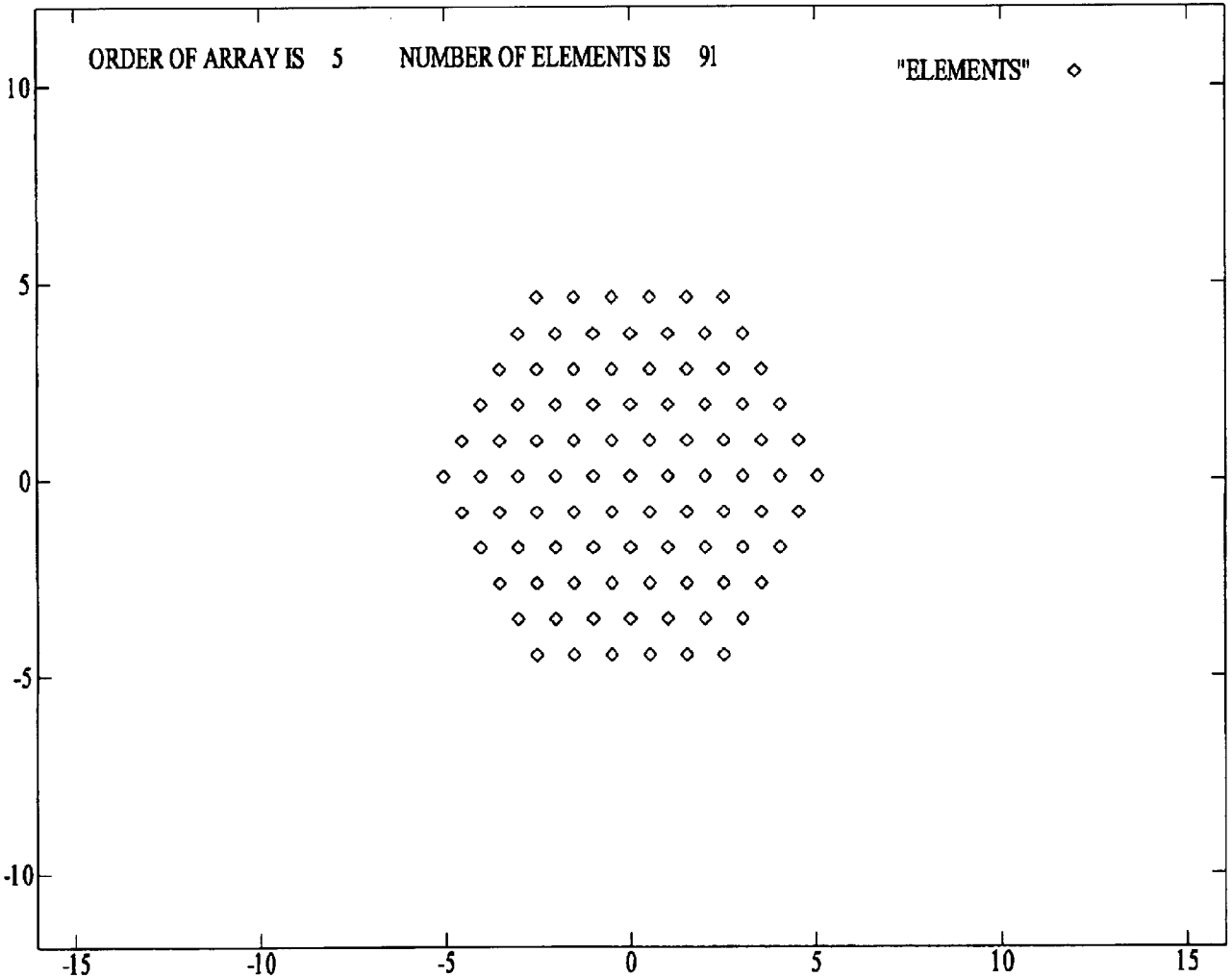
FIG. 9 (PRIOR ART)
FIG. 9 illustrates a fifth order hexagonal array of the prior art.
Figure 27:
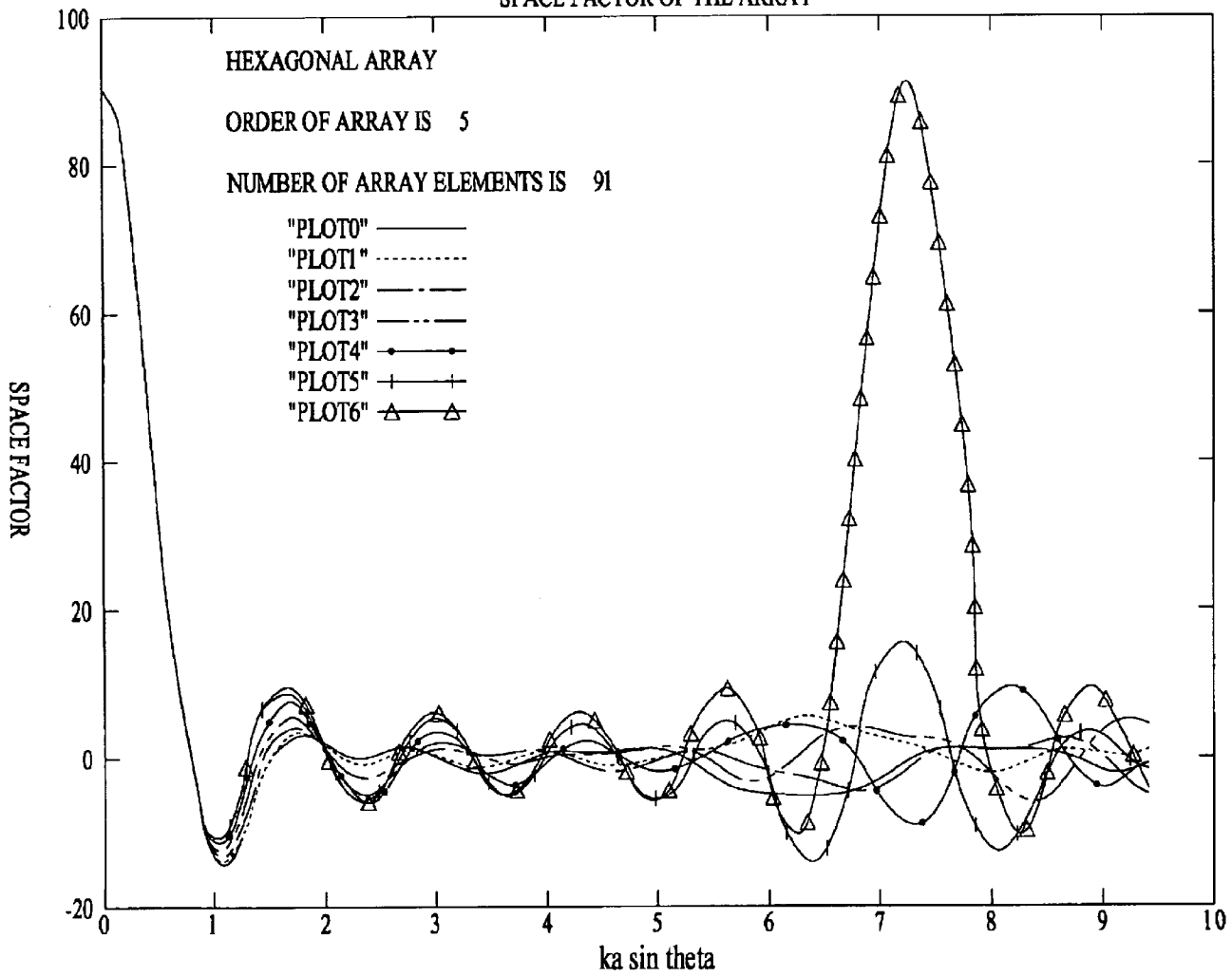
FIG. 27 (PRIOR ART)
FIG. 27 shows space factors corresponding to the element configuration of FIG. 9.

The hexagonal planar array depicted in FIG. 9 has six-fold rotational symmetry and six reflection planes. This symmetry carries over into Fourier transform space. FIG. 27 shows Fourier transforms for various rotation angles to be described.

$$S(k,\theta,\phi+\pi/3)=S(k,\theta,\phi)$$

$$S(k,\theta,-\phi)=S(k,\theta,\phi)$$

Ring (Circular) Array

Figure 10:
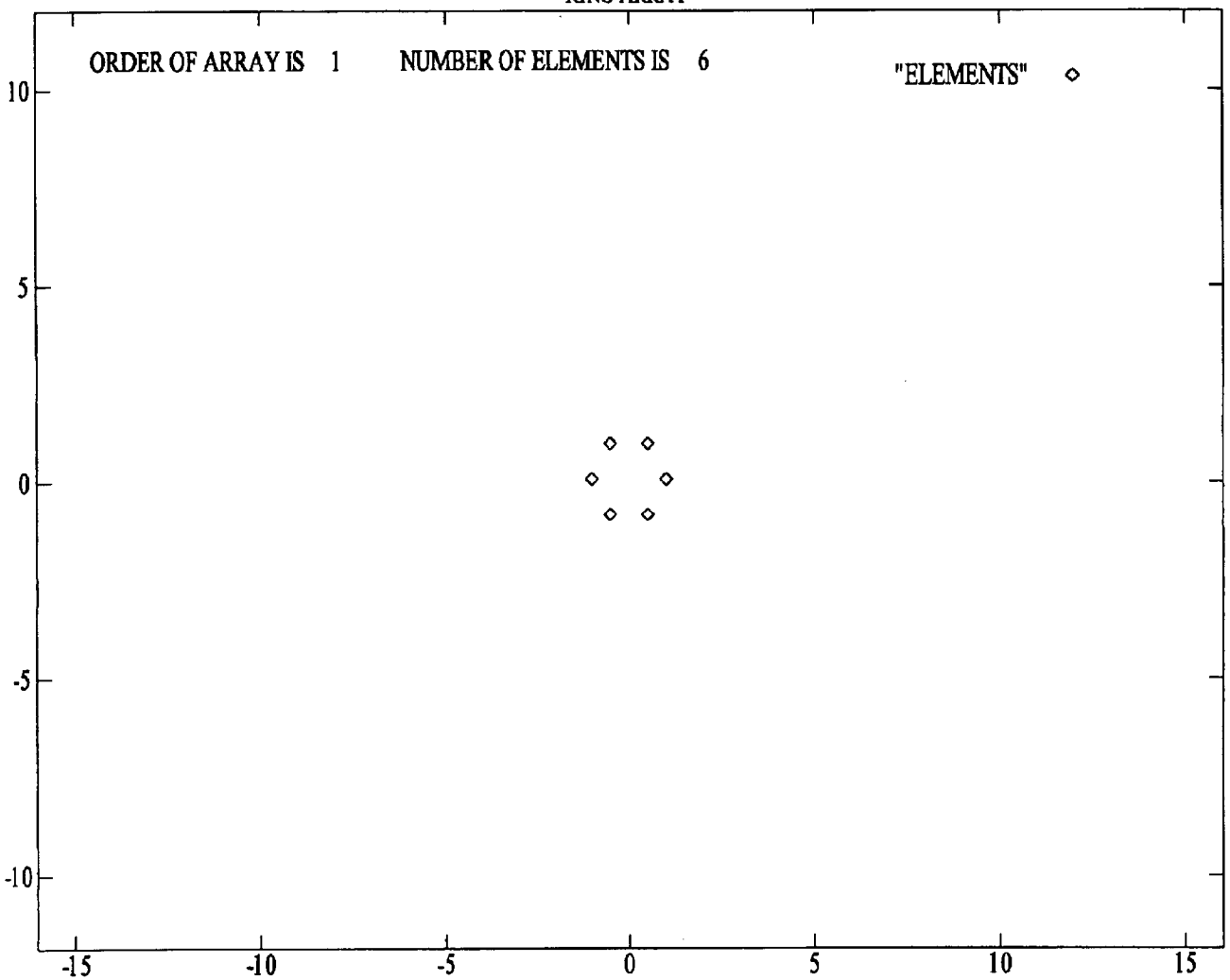
FIG. 10 (PRIOR ART)
FIG. 10 illustrates a ring array of the prior art having six elements.
Figure 28:
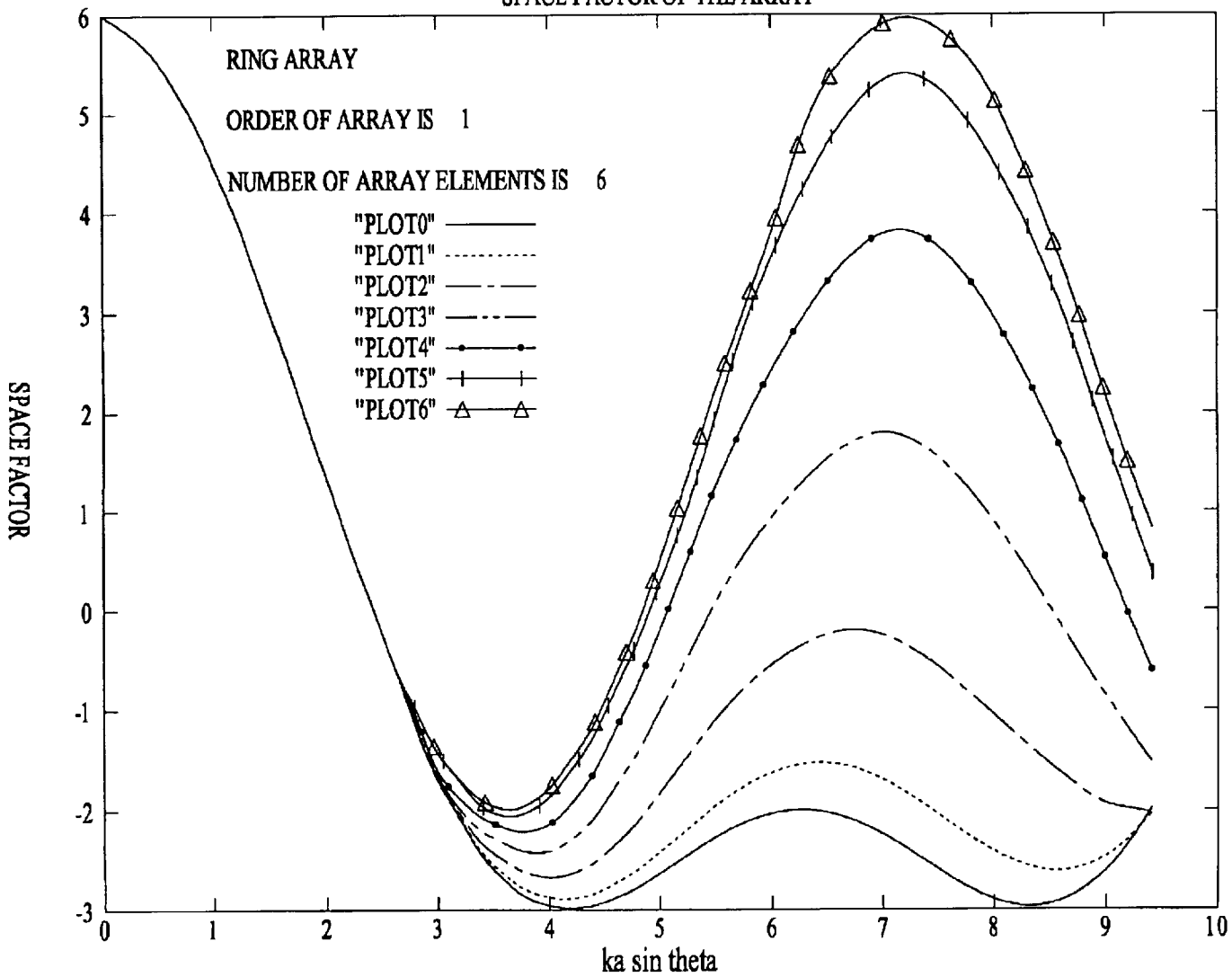
FIG. 28 (PRIOR ART)
FIG. 28 shows space factors corresponding to the element configuration of FIG. 10.

A ring planar array with six elements is depicted in FIG. 10. It has six-fold rotational symmetry and six reflection planes. This symmetry carries over into k space. FIG. 28 shows S(k) for selected rotation angles, $\phi$, to be described.

$$S(k,\theta,\phi+\pi/3)=S(k,\theta,\phi)$$

$$S(k,\theta,-\phi)=S(k,\theta,\phi)$$

Figure 11:
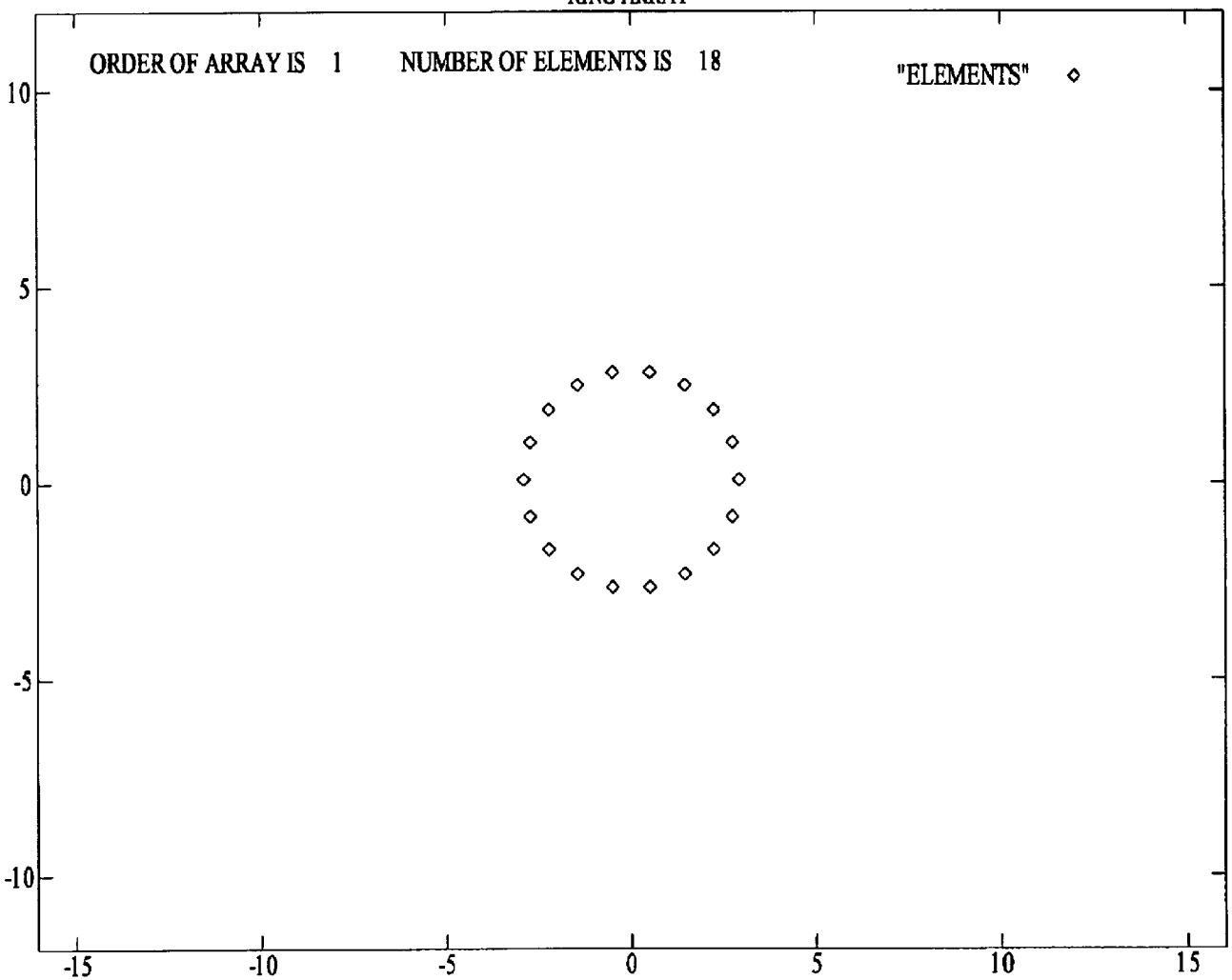
FIG. 11 (PRIOR ART)
FIG. 11 illustrates a ring array of the prior art having 18 elements.
Figure 29:
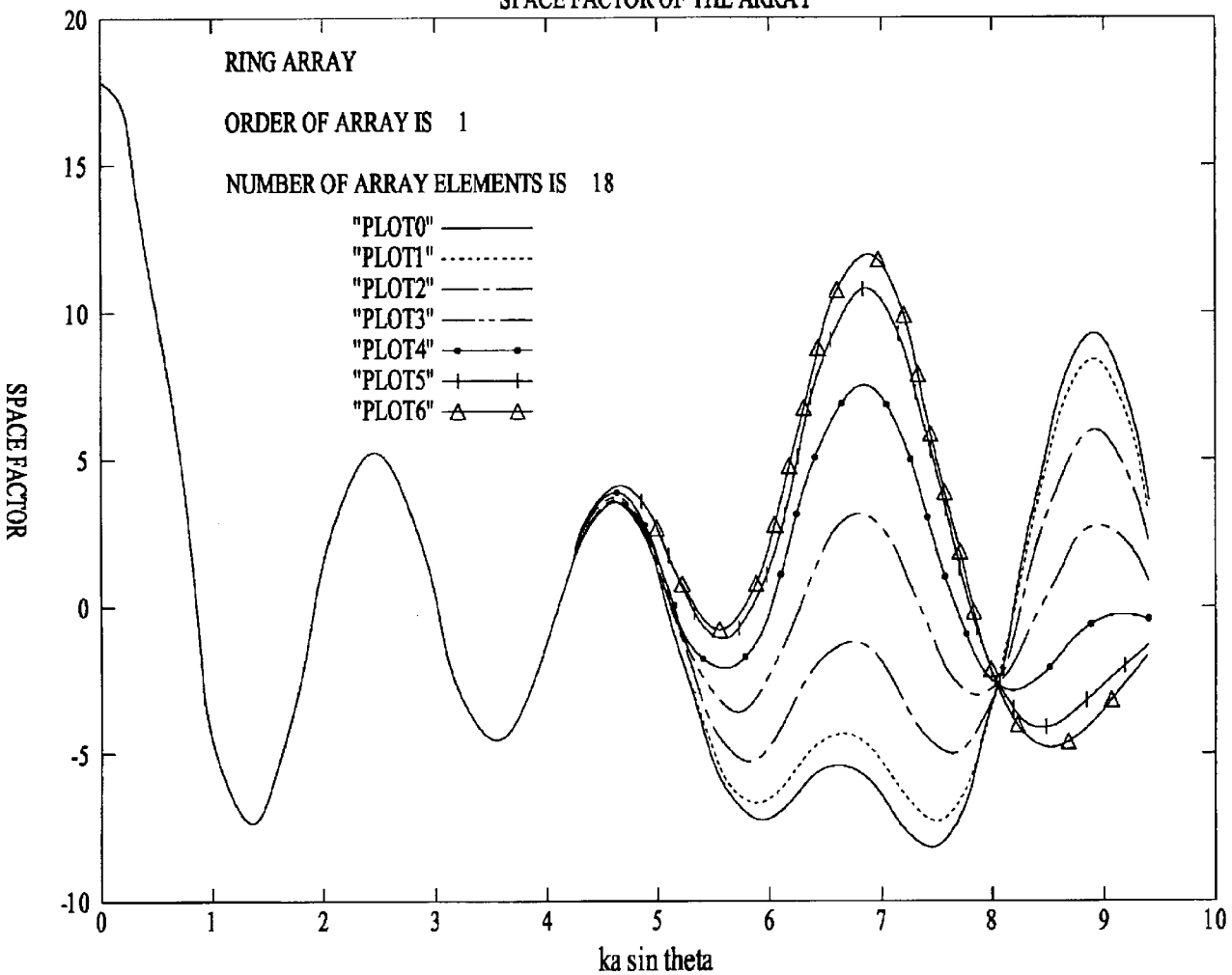
FIG. 29 (PRIOR ART)
FIG. 29 shows space factors corresponding to the element configuration of FIG. 11.

A ring planar array with 18 elements is depicted in FIG. 11. It has 18-fold rotational symmetry and 18 reflection planes. This symmetry carries over into the space factor. FIG. 29 shows S(k) for selected rotation angles, $\phi$, to be described.

$$S(k,\theta,\phi+\pi/9)=S(k,\theta,\phi)$$

$$S(k,\theta,-\phi)=S(k,\theta,\phi)$$

Spiral Lattice Array

The spiral lattice array embodied by the annular array configuration of elements, has eighteen-fold rotational symmetry. Again, this symmetry is transformed into k space.

$$S(k,\theta,\phi+\pi/9)=S(k,\theta,\phi)$$

There are, however, no reflection planes associated with this transform.

Augmented Spiral Lattice Array

The augmented spiral lattice is identical to the spiral lattice annular array configuration except that the open center defined by the annular array configuration is filled with the core configuration of elements having six-fold rotational symmetry. As a result, the augmented spiral lattice array has six-fold rotational symmetry. Again, this symmetry is transformed into k space.

$$S(k,\theta,\phi+\pi/3)=S(k,\theta,\phi)$$

As with the spiral lattice array, there are no reflection planes associated with this transform.

Comparison

FIGS. 19 through 35 are similar in some respects, but there are certain characteristics that are evident in each figure. The main beams are centered on k=0. For small values of k, the set of plots (0 through 6) are nearly identical. The following table defines the angles of rotation for the various plots in k-space.

| | Plot0 | Plot1 | Plot2 | Plot3 | Plot4 | Plot5 | Plot6 |
|---|---|---|---|---|---|---|---|
| Square | 0 deg. | 7.5 deg. | 15 deg. | 22.5 deg. | 30 deg. | 37.5 deg. | 45 deg. |
| Hexagonal | 0 deg. | 5 deg. | 10 deg. | 15 deg. | 20 deg. | 25 deg. | 30 deg. |
| Ring Array with N=6 | 0 deg. | 5 deg. | 10 deg. | 15 deg. | 20 deg. | 25 deg. | 30 deg. |
| Ring Array with N=18 | 0 deg. | 1.667 deg. | 3.333 deg. | 5 deg. | 6.667 deg. | 8.333 deg. | 10 deg. |
| Augmented Spiral Lattice | 0 deg. | 10 deg. | 20 deg. | 30 deg. | 40 deg. | 50 deg. | 60 deg. |
| Spiral Lattice | 0 deg. | 3.333 deg. | 6.667 deg. | 10 deg. | 13.333 deg. | 16.667 deg. | 20 deg. |

If plots 0 through 6 are nearly identical in a given figure then the array factors are nearly circularly symmetric.

General Characteristics of the Array Factors of the Square Arrays

FIGS. 19 through 22 share several common characteristics. At k=2 π on plot 0 a grating lobes is evident. At the center of a grating lobe the response is the same as at the center of the main beam (at K=0). This grating lobe is also present at other integer multiples of (2 π) though these higher multiple lobes are not evident on these plots. As the number of elements in the square array increases, the width of the main beam decreases.

General Characteristics of the Array Factors of the Hexagonal Arrays

FIGS. 23 through 27 demonstrate the characteristics of the array factors of hexagonal arrays. In many ways these are similar to the array factors of square arrays. Grating lobes appear at $\phi$=30 degrees, (ka sin $\phi$)=4 π/sqrt(3). The hexagonal array space factor has 12 symmetry elements while that of the square has 8 symmetry elements. As with the square array, as the number of array elements increases the width of main beam decreases.

General Characteristics of the Array Factors of the Ring (Circular) Arrays

FIGS. 28 and 29 show the properties of the array factors of circular or ring arrays. A readily noticeable property of these array factors is that they do not have grading lobes. This property makes the ring array useful in direction finding applications.

General Characteristics of Spiral Lattice/Augmented Spiral Lattice Array Factors The spiral lattice annular configuration and augmented spiral lattice arrays are nestings of several ring arrays in specific orientation. The augmented spiral lattice arrays tend to have a smaller first side-lobe than the spiral lattice annular configuration array of the same order. The following are some of the notable characteristics of the these arrays:

1. They are devoid of grating lobes.
2. When compared to circular arrays they tend to have smaller side-lobes.
3. They have a high degree of rotational symmetry and are nearly circularly symmetric over a wide range of frequencies.

The specifics of element location and relationship for these novel sensor arrays will now be described.

The arrangement of array elements can include either or both of the following geometries:

(1) a six-fold core lattice configuration, (2) an 18-fold annular lattice configuration of elements. The total number of elements is a function of array design.

Figure 17:
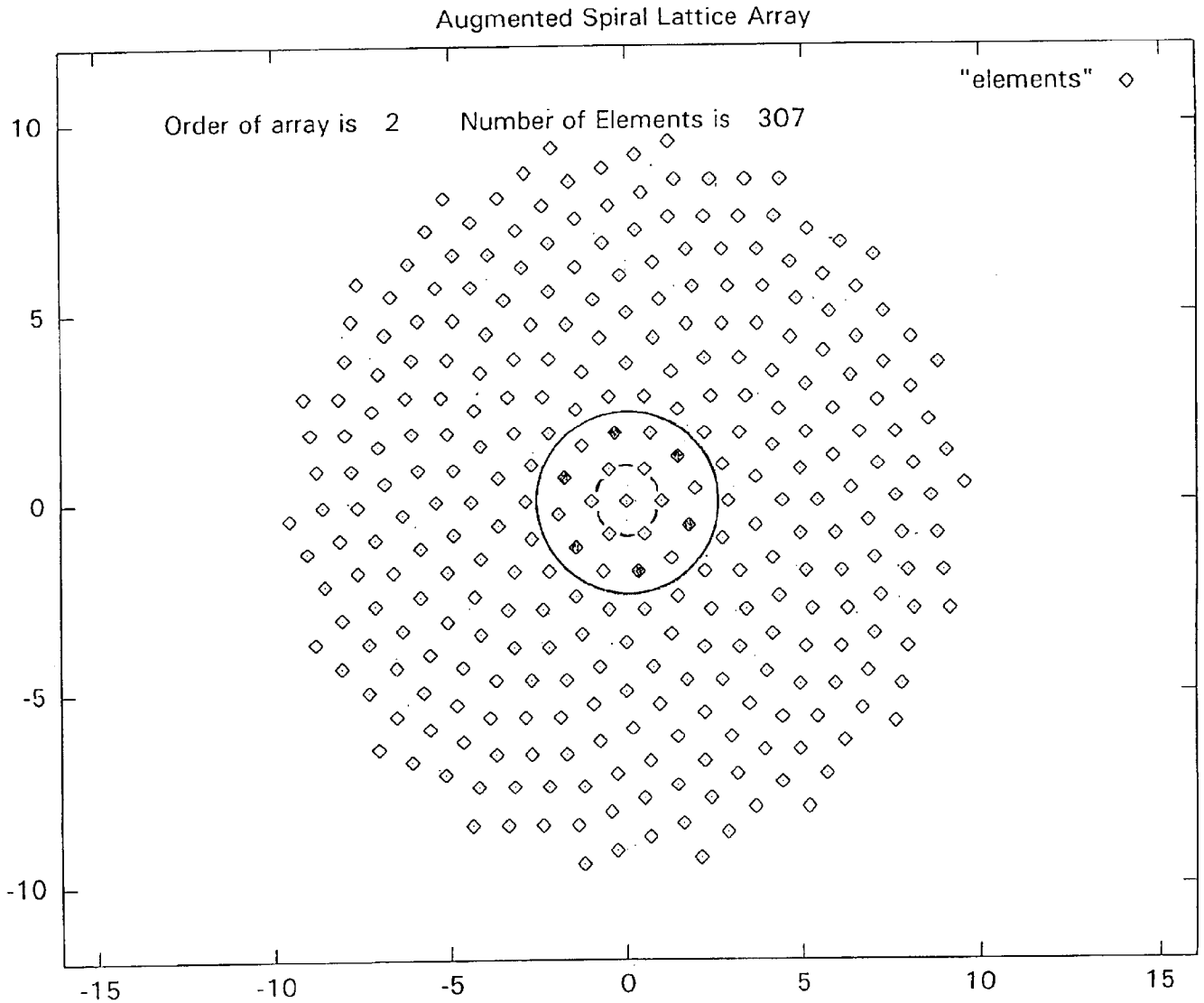
FIG. 17 illustrates an augmented annular configuration of a spiral lattice array of order two.
Figure 18:
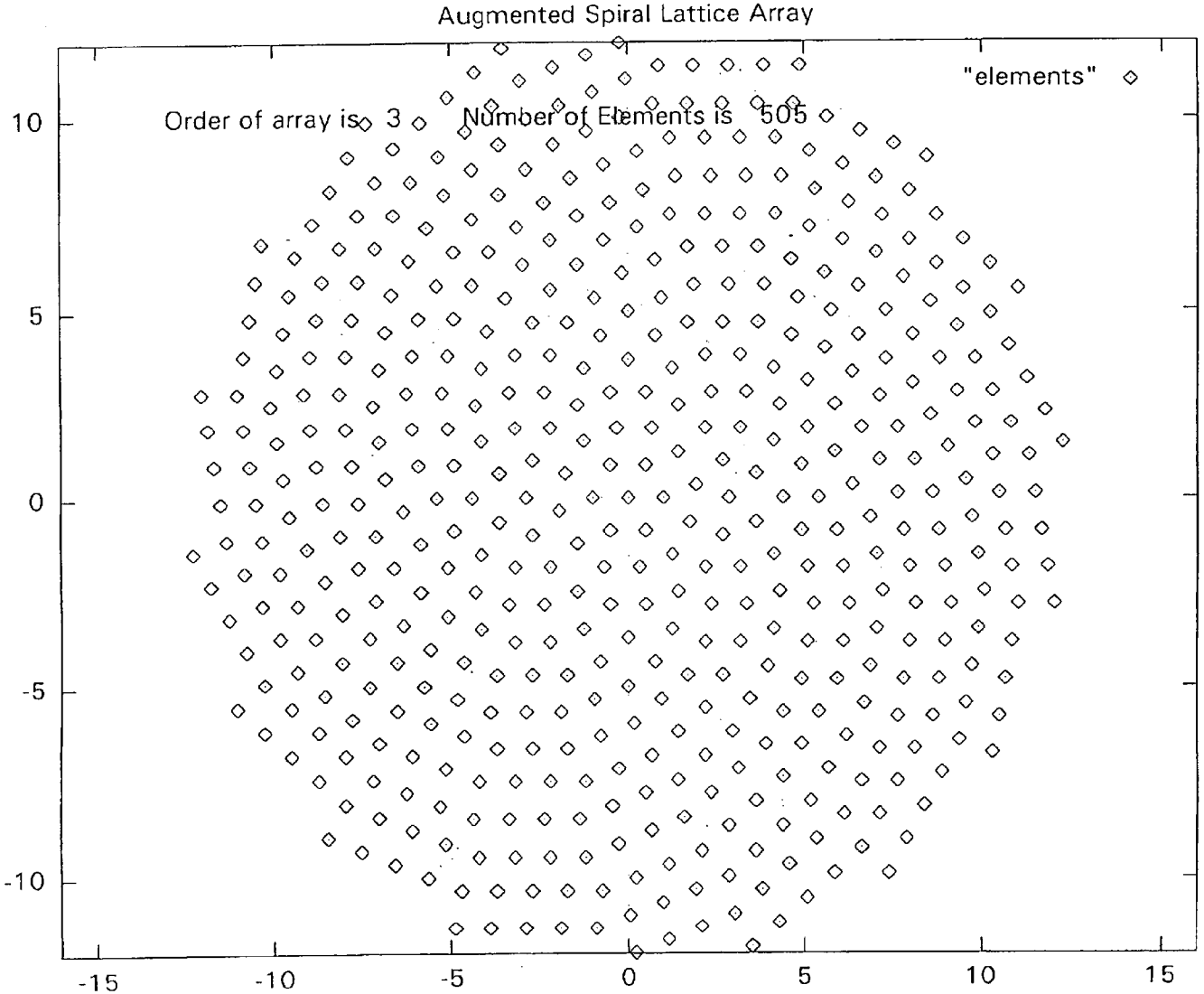
FIG. 18 illustrates an augmented annular configuration of a spiral lattice array of order three.
Figure 19:
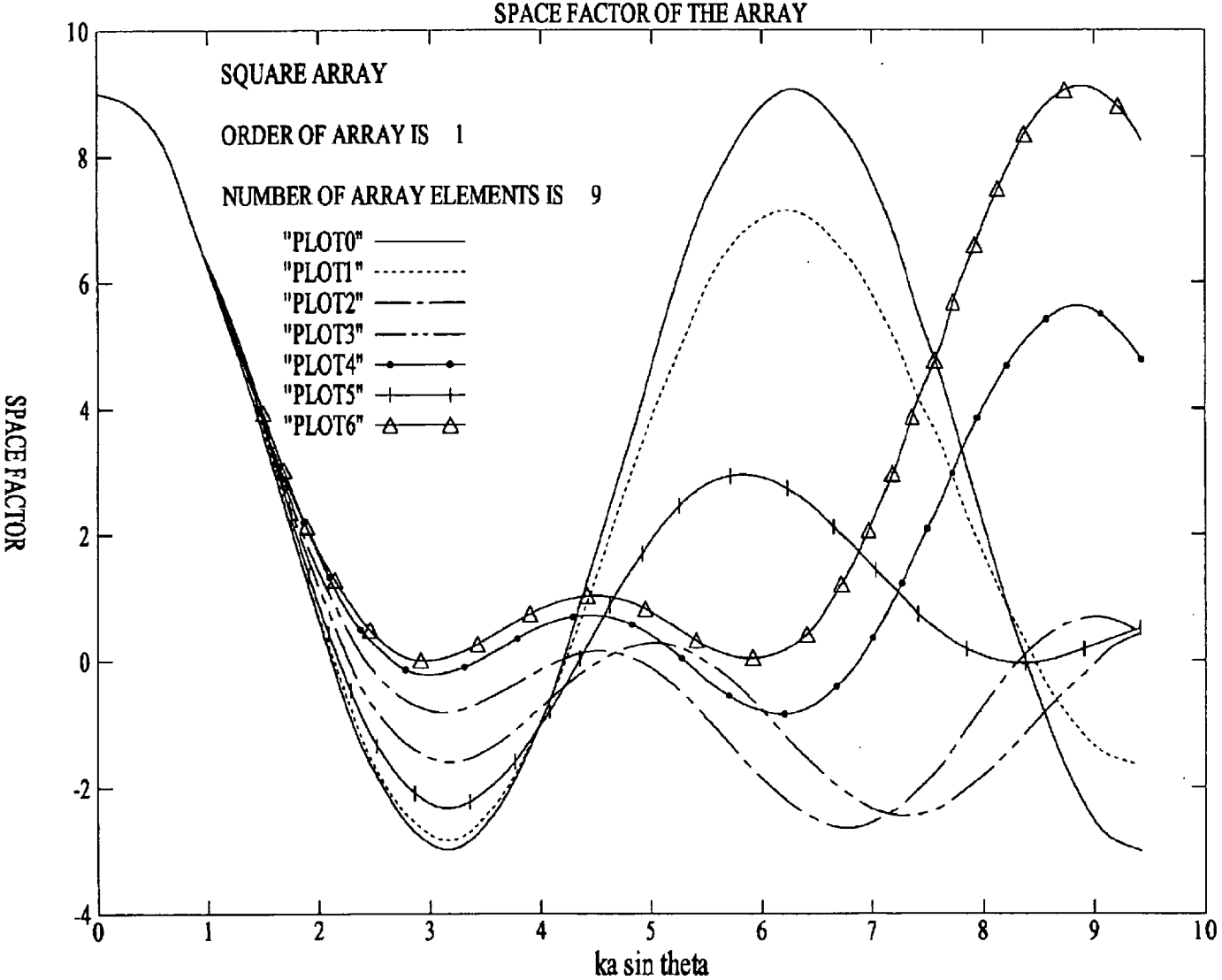
FIG. 19 (PRIOR ART)
FIG. 19 shows space factors corresponding to the element configuration of FIG. 1.
Figure 20:
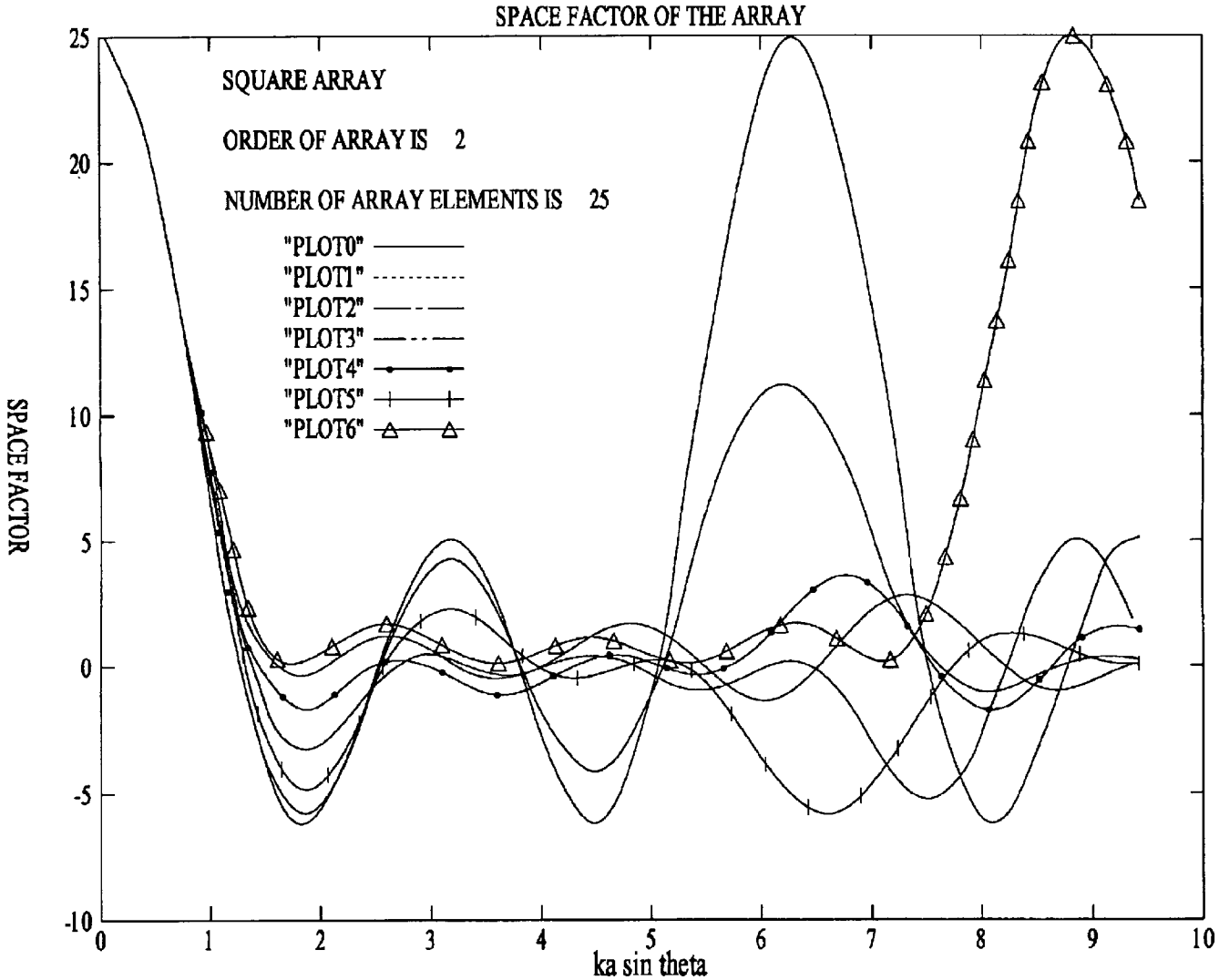
FIG. 20 (PRIOR ART)
FIG. 20 shows space factors corresponding to the element configuration of FIG. 2.
Figure 21:
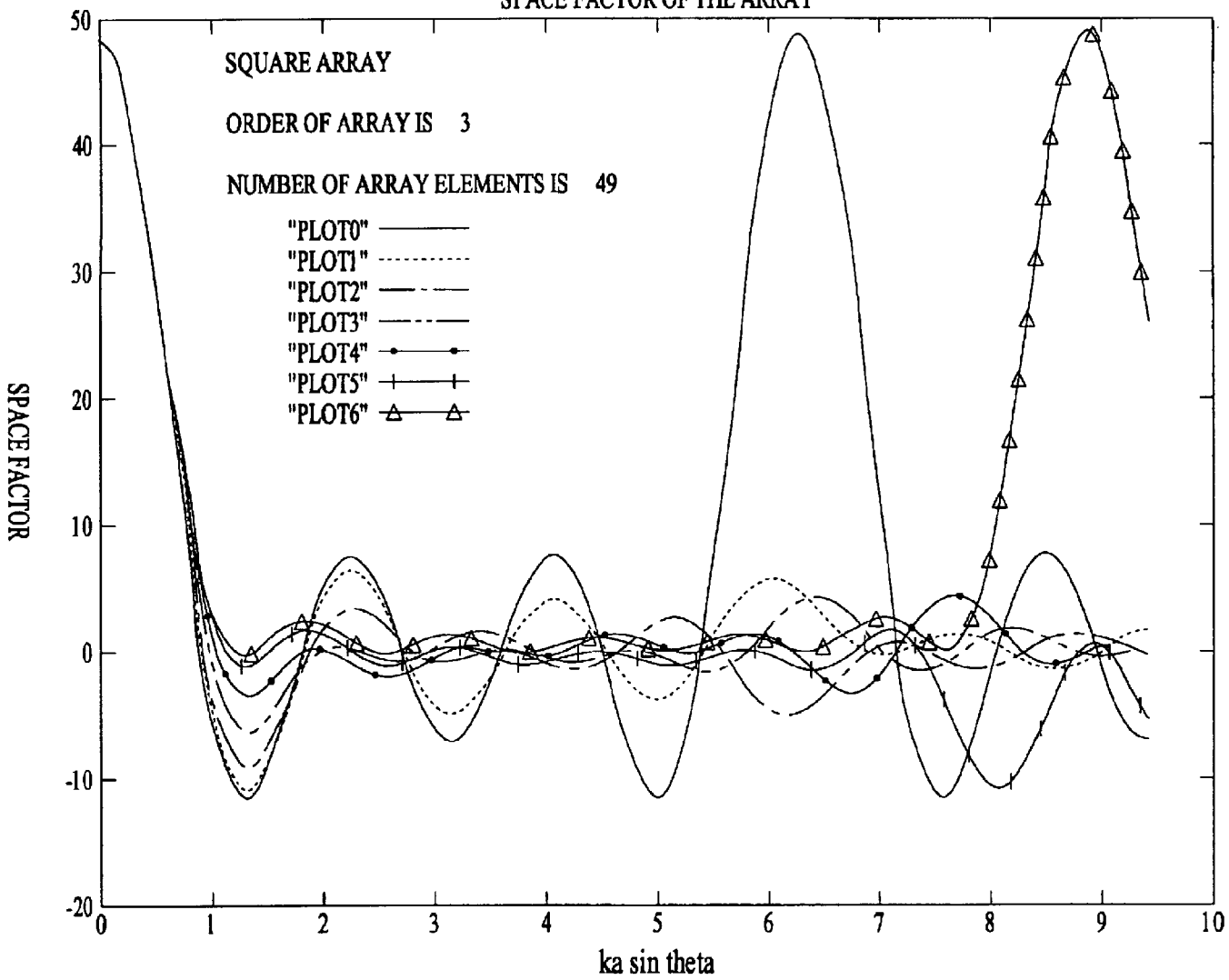
FIG. 21 (PRIOR ART)
FIG. 21 shows space factors corresponding to the element configuration of FIG. 3.
Figure 22:
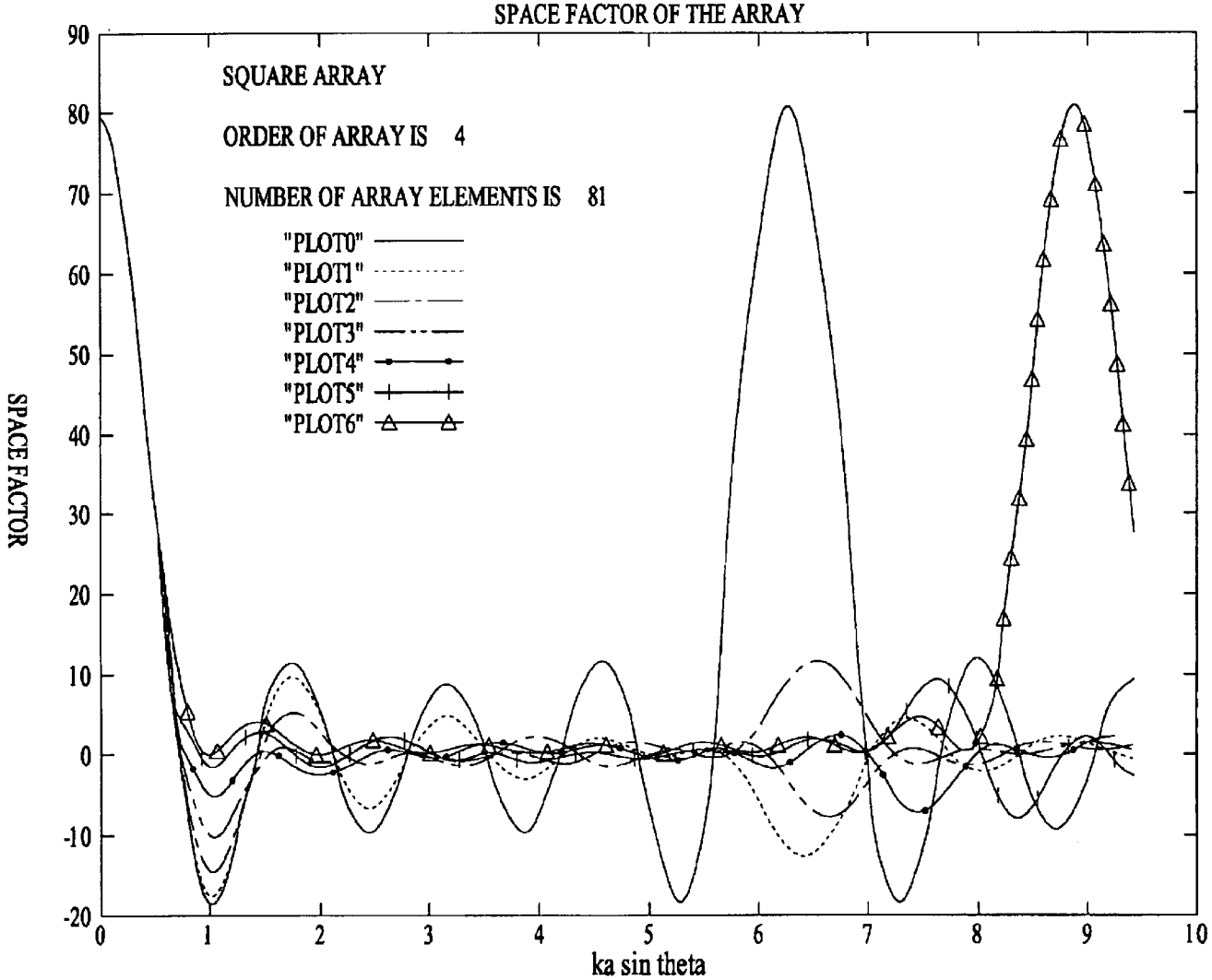
FIG. 22 (PRIOR ART)
FIG. 22 shows space factors corresponding to the element configuration of FIG. 4.
Figure 23:
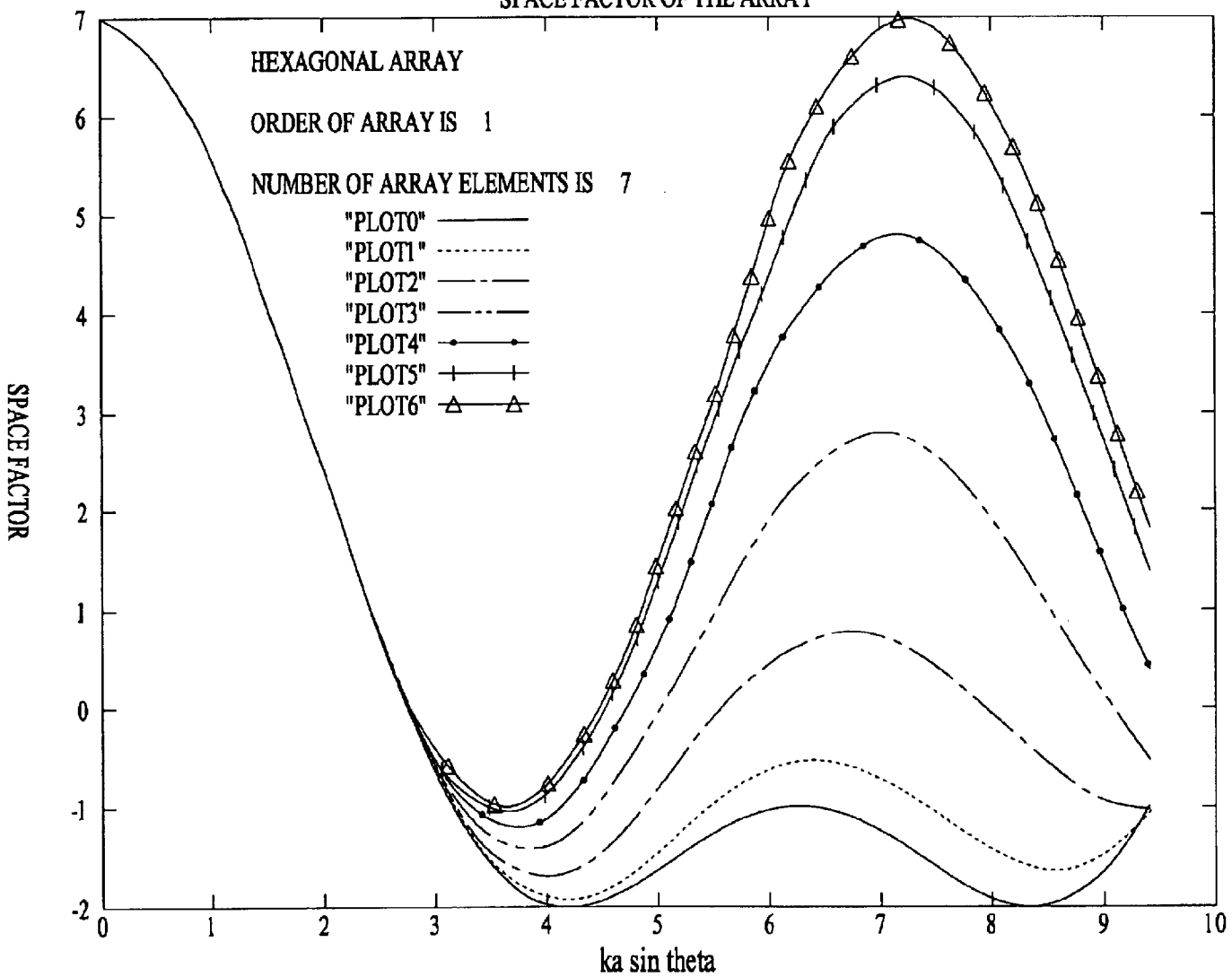
FIG. 23 (PRIOR ART)
FIG. 23 shows space factors corresponding to the element configuration of FIG. 5.
Figure 24:
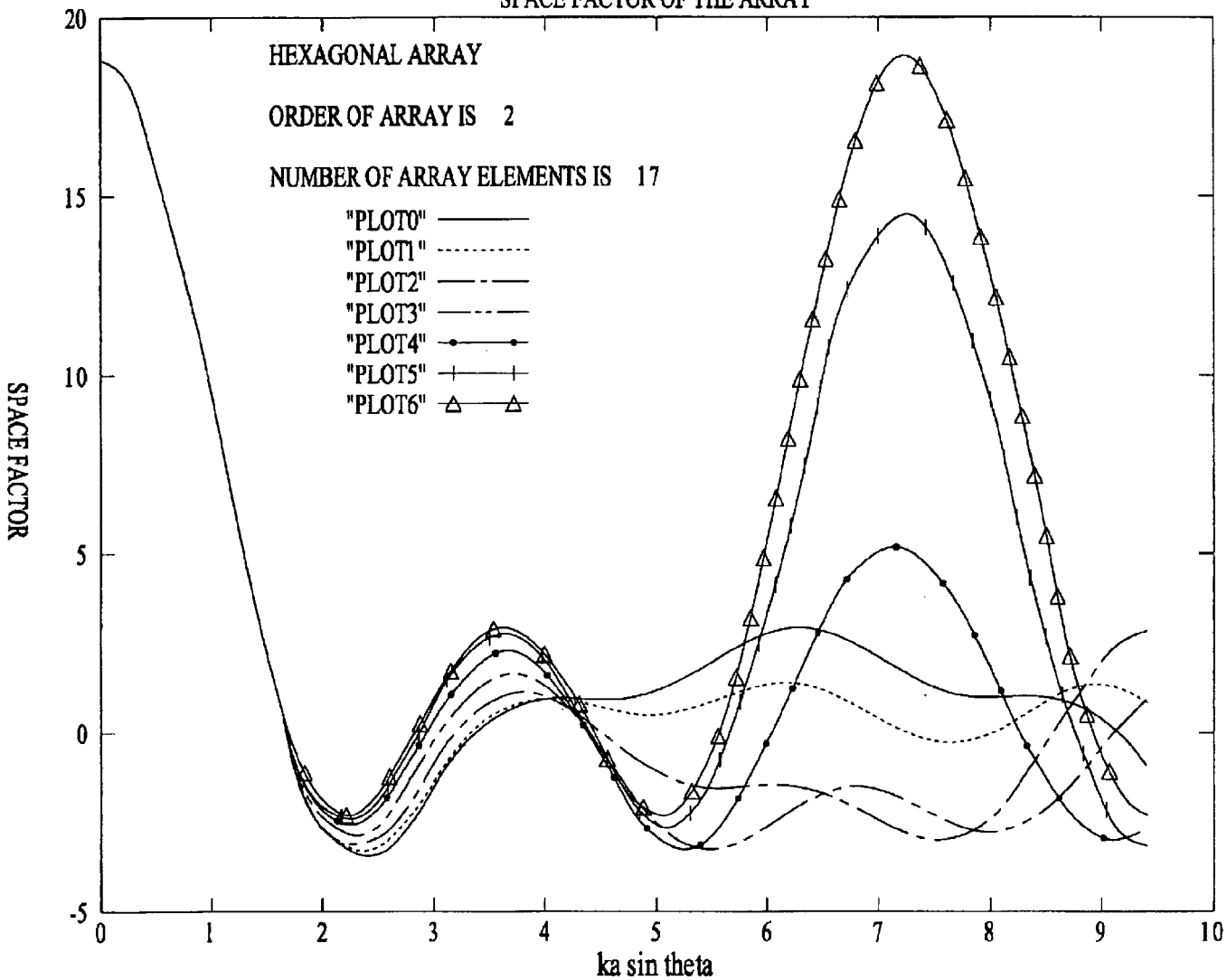
FIG. 24 (PRIOR ART)
FIG. 24 shows space factors corresponding to the element configuration of FIG. 6.
Figure 25:
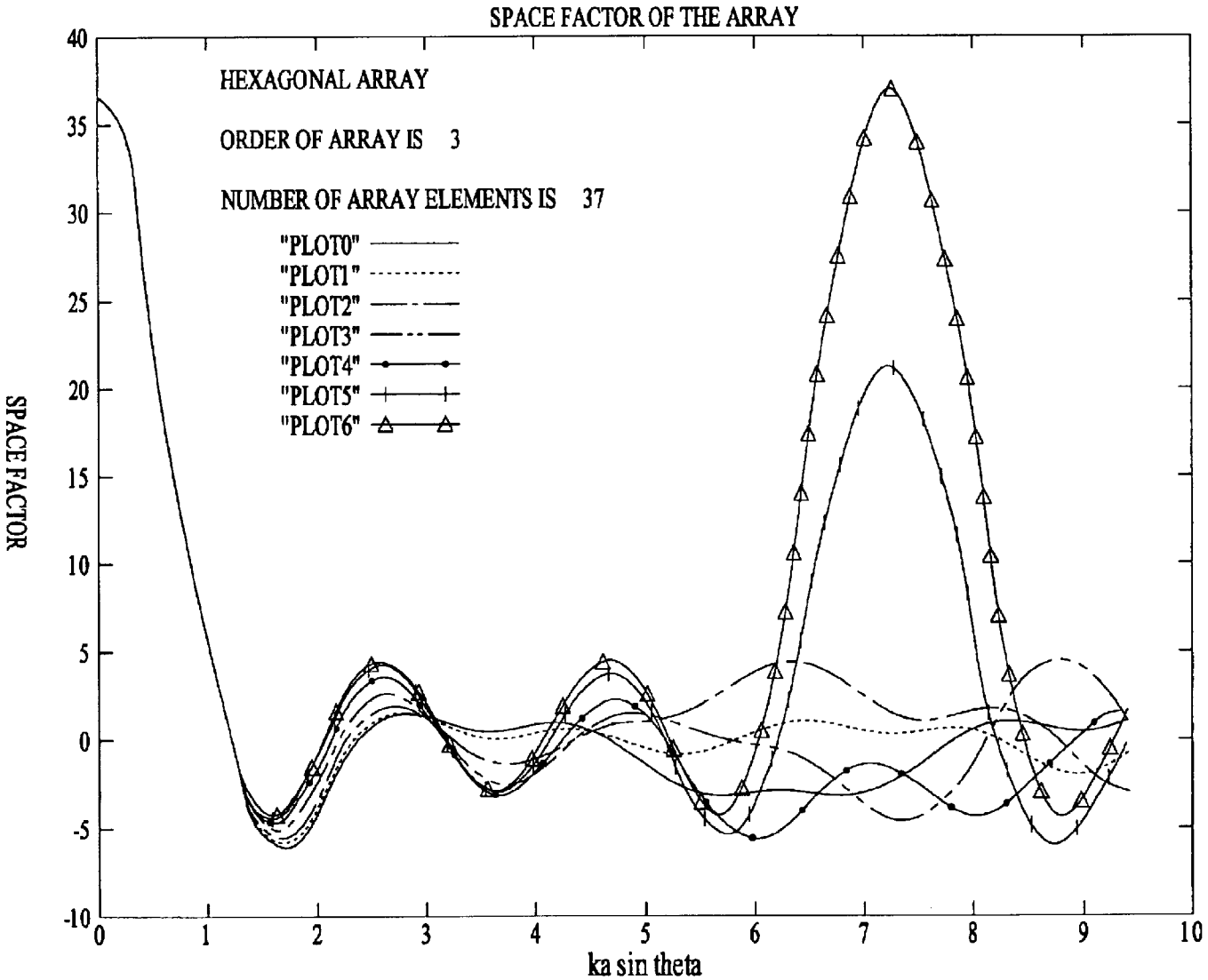
FIG. 25 (PRIOR ART)
FIG. 25 shows space factors corresponding to the element configuration of FIG. 7.
Figure 26:
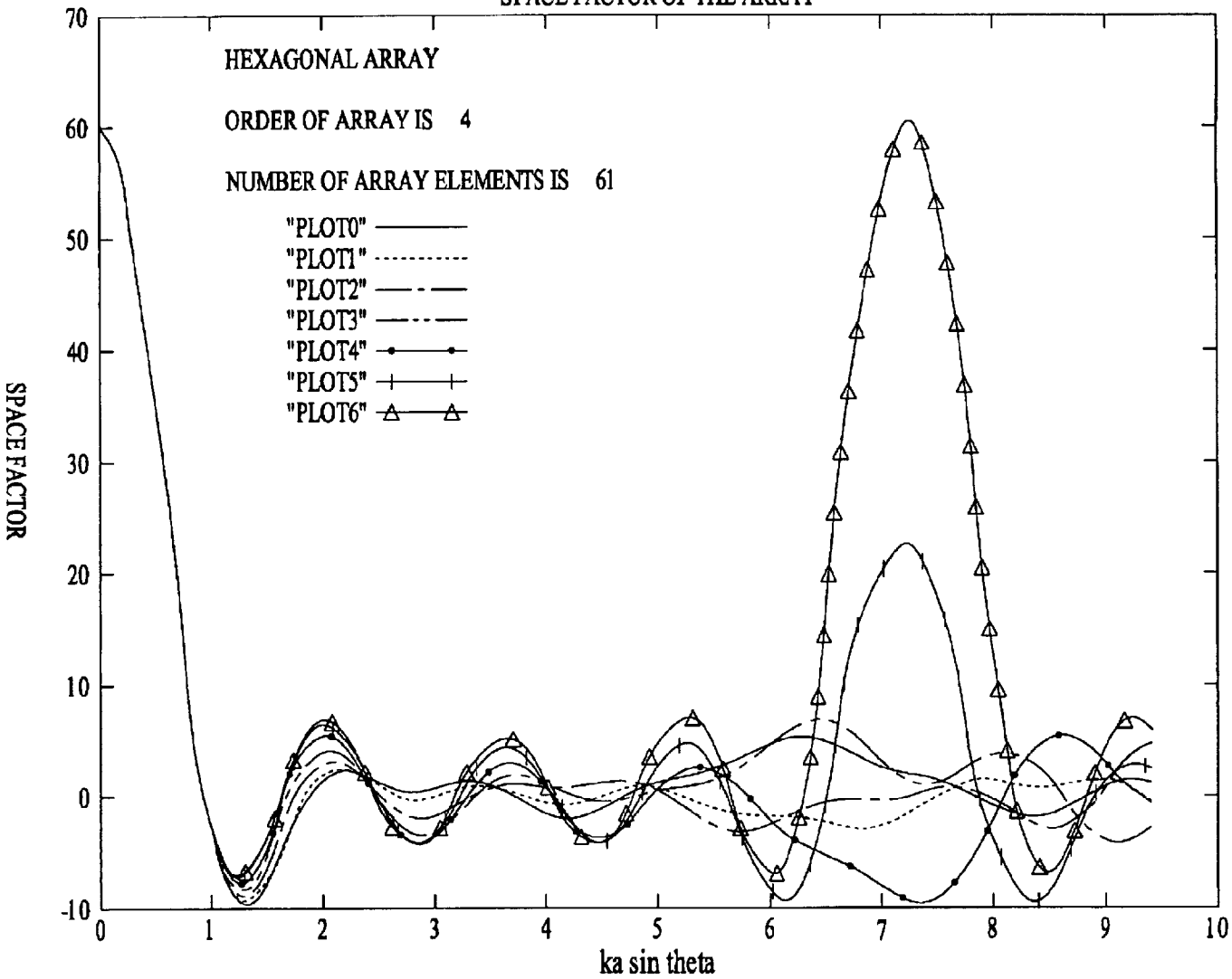
FIG. 26 (PRIOR ART)
FIG. 26 shows space factors corresponding to the element configuration of FIG. 8.

The following is a mathematical description of the array element locations wherein Px(R,S) is an "x" Cartesian element coordinate and Py(R,S) is a "y" Cartesian element coordinate with S being a sensor number corresponding to a sensor ring R:

(1) Core configuration elements: Referring to FIG. 17, there may be as many as 19 core elements in the encircled core of the array. At the center of the array is an optional central element. There are six elements in the first ring out from the center, shown in this figure connected with lines. In Cartesian coordinates these locations can be defined as:

| | |
|---|---|
| Px(1,1) = α cos(0) = α | Py(1,1) = 0 sin(0)= 0. |
| Px(1,2) = α cos(60) | Py(1,2) = α sin(60) |
| Px(1,3) = α cos(120) | Py(1,3) = α sin(120) |
| Px(1,4) = α cos(180 = −a | Py(1,4) = α sin(180) = 0 |
| Px(1,5) = α cos(240) | Py(1,5) = α sin(240) |
| Px(1,6) = α cos(300) | Py(1,6) = α sin(300) |

where the angles are given in degrees.

The second ring of the core array, shown in FIG. 17 as blackened diamonds, consists of six elements whose coordinates are:

| | |
|---|---|
| Px(2,1) = α (cos(0) + cos(40)) | Py(2,1) = α (sin(0) − sin(40)) |
| Px(2,2) = α (cos(60) + cos(20)) | Py(2,2) = α (sin(60) + sin(20)) |
| Px(2,3) = α (cos(120) + cos(80)) | Py(2,3) = α (sin(120) + sin(80)) |
| Px(2,4) = α (cos(180) + cos(140)) | Py(2,4) = α (sin(180) + sin(140)) |
| Px(2,5) = α (cos(240) + cos(200)) | Py(2,5) = α (sin(240) + sin(200)) |
| Py(2,6) = α (cos(300) + cos(260)) | Py(2,6) = α (sin(300) + sin(260)) |

In the third ring of the core array there are six elements, shown in FIG. 17 as the encircled radially outermost diamonds. Their coordinates are:

| | |
|---|---|
| Px(3,1) = α (cos(0) + cos(20)) | Py(3,1) = α (sin(0) + sin(20)) |
| Px(3,2) = α (cos(60) + cos(80)) | Py(3,2) = α (sin(60) + sin(80)) |
| Px(3,3) = α (cos(120) + cos(140)) | Py(3,3) = α (sin(120) + sin(140)) |
| Px(3,4) = α (cos(180) + cos(200)) | Py(3,4) = α (sin(180) + sin(200)) |
| Px(3,5) = α (cos(240) + cos(260)) | Py(3,5) = α (sin(240) + sin(260)) |
| Py(3,6) = α (cos(300) + cos(320)) | Py(3,6) = α (sin(300) + sin(320)) |

If the center element and all three core rings are used then there are a total of 19 elements in the core array.

Referring to FIG. 14, the element locations in the annular array configuration are defined as follows:

Elements in the radially innermost first ring of the annular array configuration have the following coordinates:

| | |
|---|---|
| Px(1,1) = a1(cos(0)) | Py(1,1) = a1 (sin(0)) |
| Px(1,2) = a1(cos(20)) | Py(1,2) = a1 (sin(20)) |

-continued

| | |
|---|---|
| Px(1,3) = a1(cos(40)) | Py(1,3) = a1 (sin(40)) |
| . | . |
| . | . |
| . | . |
| Px(1,n) = a1(cos(20n)) | Py(1,n) = a1 (sin(20(n− 1))) |

where a1 = α (1 + 2 cos(20)) and
n = 1, 2, 3, . . . 18.

Elements in the second ring of the annular array configuration, shown connected by single dots, have the following coordinates:

| | |
|---|---|
| Px(2,1) = a1 cos(0) + α cos(40) | Py(2,1) = a1 sin(0) + α sin(40) |
| Px(2,2) = a1 cos(20) + α cos(60) | Py(2,2) = a1 sin(20) + α sin(60) |
| Px(2,3) = a1 cos(40) + α cos(80) | Py(2,3) = a1 sin(40) + α sin(80) |
| . | . |
| . | . |
| . | . |
| Px(2,n) = a1 cos(20(n − 1)) + α cos(20(n + 1)) | Py(2,n) = a1 (sin(20(n − 1)) + α sin(20(n + 1)) |

n = 1, 2, 3, . . . 18.

Elements in the third ring of the annular array configuration, shown connected by double dots, have the following coordinates:

| | |
|---|---|
| Px(3,1) = a1 cos(0) + α cos(40) + α cos(60) | Py(3,1) = a1 sin(0) + α sin(40) + α sin(60) |
| Px(3,2) = a1 cos(20) + α cos(60) m + α cos(80) | Py(3,2) = a1 sin(20) + α sin(60) + α sin(80) |
| Px(3,3) = a1 cos(40) + α cos(80) + α cos(100) | Py(3,3) = a1 sin(40) + α sin(80) + α sin(100) |
| . | . |
| . | . |
| . | . |
| Px(3,n) = a1 cos(20(n − 1)) + α cos(20(n + 1)) + α cos(20(n + 2)) | Py(3,n) = a1 sin(20(n − 1)) + α sin(20(n + 1)) + α sin(20(n + 2)) |

n = 1, 2, 3, . . . 18

Elements in the fourth ring of the annular array configuration, shown connected by triple dots, have the following coordinates:

Px(4,1) = a1 cos(0) + α cos(40) + α cos(60) + α cos(80)
Py(4,1) = a1 sin(0) + α sin(40) + α sin(60) + α sin(80)
Px(4,2) = a1 cos(20) + α cos(60) + α cos(80) + α cos(100)
Py(4,2) = a1 sin(20) + α sin(60) + α sin(100) + α sin(100)
Px(4,3) = a1 cos(40) + α cos(80) + α cos(100) + α cos(120)
Py(4,3) = a1 sin(40) + α sin(80) + α sin(100) + α sin(120)
.
.
.
Px(4,n) = a1 cos(20(n − 1)) + α cos(20(n + 1)) + α cos(20(n + 2)) + α cos(20(n + 3))
Py(4,n) = a1 sin(20(n − 1)) + α sin(20(n + 1)) + α sin(20(n + 2)) + α sin(20(n + 3))

n = 1, 2, 3, . . . 18

Elements in other rings of the annular array are generated by:

Px(i,j,1,n) = Px(1,n) + i ux(n) + j vx(n)
Py(i,j,1,n) = Py(1,n) + i uy(n) + j vy(n)

-continued where i = 1, 2, 3, 4, 5, . . . and
j = 0, 1, 2, . . . (i − 1)
Px(i,j,2,n) = Px(2,n) + i ux(n) + j vx(n)
Py(i,j,2,n) = Py(2,n) + i uy(n) + j vy(n)
where i = 1, 2, 3, 4, 5, . . . and
j = 0, 1, 2, . . . i
Px(i,j,3,n) = Px(3,n) + i ux(n) + j vx(n)
Py(i,j,3,n) = Py(3,n) + i uy(n) + j vy(n)
where i = 1, 2, 3, 4, 5, . . . and
j = 0, 1, 2, . . . i
Where
ux(n) = α cos(20(n + 1)) + α cos(20(n + 2)) + α cos(20(n + 3))
uy(n) = α sin(20(n + 1)) + α sin(20(n + 2)) + α sin(20(n + 3))
vx(n) = α cos(20(n + 7))
vy(n) = α sin(20(n + 7))

It should be noted that the distance of the element location from the center of the array is independent of n. These locations can be arranged into rings of increasing radius.

The invention results in an array response that minimizes grating lobes. It also has smaller side-lobes than square, hexagonal, or ring arrays with a comparable number of elements.

The array can be constructed with or without core elements and can be constructed with or without annular elements. The total number of elements is left to the discretion of the designer.

While these arrays may be used with sensor elements such as antennas, the sensor elements may also be transponders.

Obviously, many modifications and variations of the invention are possible in light of the above description. It is therefore to be understood that within the scope of the claims the invention may be practiced otherwise than as has been specifically described.

What is claimed is:

1. An apparatus comprising:

a sensor array having at least one set of five sensor elements wherein for each set of sensor elements an element is disposed at a vertex of an equilateral non-equiangular pentagon wherein said sensor is a transponder.

2. An apparatus comprising:

a sensor array having at least one set of five sensor elements wherein for each set of sensor elements an element is disposed at a vertex of an equilateral non-eguiangular pentagon wherein a plurality of said sets of said sensor elements form a planar annular configuration of elements having eighteen-fold rotational symmetry, said sets of elements sharing one or more elements of neighboring sets of elements.

3. An apparatus according to claim 2 further including a second plurality of said sets of sensor elements, said second plurality of said sets of sensor elements forming a planar core configuration of elements and having a common central element and having six-fold rotational symmetry, wherein said second plurality of said sets of sensor elements is disposed within a centrally located open center defined by said planar annular configuration of elements and is arranged to be coplanar therewith.

4. An apparatus comprising:

a sensor array having at least one set of five sensor elements wherein for each set of sensor elements an element is disposed at a vertex of an equilateral non-equiangular pentagon wherein a plurality of said sets of sensor elements form a planar core configuration of elements having a common central element, said core configuration having six-fold rotational symmetry.

5. An apparatus comprising:

a sensor array having at least one set of five sensor elements wherein for each set of sensor elements an element is disposed at a-vertex of an equilateral non-equiangular pentagon wherein said equilateral non-equiangular pentagon has interior angles of 60, 160, 80, 100 and 140 degrees.

6. A sensor array apparatus comprising:

a planar core configuration of sensor elements wherein said sensor elements are separated by a distance α from nearest neighbor sensor elements and are located with respect to a central point, including a first sensor element located at said central point;

a first ring of six of said sensor elements located from said central point, said elements having Cartesian coordinate locations wherein angles are expressed in degrees defined as:

| | |
|---|---|
| $Px(1,1) = \alpha \cos(0) = \alpha$ | $Py(1,1) = 0 \sin(0) = 0$ |
| $Px(1,2) = \alpha \cos(60)$ | $Py(1,2) = \alpha \sin(60)$ |
| $Px(1,3) = \alpha \cos(120)$ | $Py(1,3) = \alpha \sin(120)$ |
| $Px(1,4) = \alpha \cos(180) = -\alpha$ | $Py(1,4) = \alpha \sin(180) = 0$ |
| $Px(1,5) = \alpha \cos(240)$ | $Py(1,5) = \alpha \sin(240)$ |
| $Px(1,6) = \alpha \cos(300)$ | $Py(1,6) = \alpha \sin(300)$; |

a second ring of six of said sensor elements from said central point, said elements having Cartesian coordinate locations wherein angles are expressed in degrees defined as:

| | |
|---|---|
| $Px(2,1) = \alpha (\cos(0) + \cos(40))$ | $Py(2,1) = \alpha (\sin(0) - \sin(40))$ |
| $Px(2,2) = \alpha (\cos(60) + \cos(20))$ | $Py(2,2) = \alpha (\sin(60) + \sin(20))$ |
| $Px(2,3) = \alpha (\cos(120) + \cos(80))$ | $Py(2,3) = \alpha (\sin(120) + \sin(80))$ |
| $Px(2,4) = \alpha (\cos(180) + \cos(140))$ | $Py(2,4) = \alpha (\sin(180) + \sin(140))$ |
| $Px(2,5) = \alpha (\cos(240) + \cos(200))$ | $Py(2,5) = \alpha (\sin(240) + \sin(200))$ |
| $Py(2,6) = \alpha (\cos(300) + \cos(260))$ | $Py(2,6) = \alpha (\sin(300) + \sin(260))$; |

and a third ring of six of said sensor elements from said central point, said elements having Cartesian coordinate locations wherein angles are expressed in degrees defined as:

| | |
|---|---|
| $Px(3,1) = \alpha (\cos(0) + \cos(20))$ | $Py(3,1) = \alpha (\sin(0) + \sin(20))$ |
| $Px(3,2) = \alpha (\cos(60) + \cos(80))$ | $Py(3,2) = \alpha (\sin(60) + \sin(80))$ |
| $Px(3,3) = \alpha (\cos(120) + \cos(140))$ | $Py(3,3) = \alpha (\sin(120) + \sin(140))$ |
| $Px(3,4) = \alpha (\cos(180) + \cos(200))$ | $Py(3,4) = \alpha (\sin(180) + \sin(200))$ |
| $Px(3,5) = \alpha (\cos(240) + \cos(260))$ | $Py(3,5) = \alpha (\sin(240) + \sin(260))$ |
| $Py(3,6) = \alpha (\cos(300) + \cos(320))$ | $Py(3,6) = \alpha (\sin(300) + \sin(320))$, |

wherein Px(R,S) is an "x" Cartesian coordinate and Py(R,S) is a "y" Cartesian coordinate and S is a sensor number corresponding to a sensor ring R.

7. An apparatus according to claim 6 wherein said sensor elements are antenna elements.

8. An apparatus according to claim 6 wherein said sensor elements are transponders.

9. A sensor array apparatus comprising:

a planar annular configuration of sensor elements wherein said sensor elements are separated by a distance α from nearest neighbor sensor elements and are located with respect to a central point, including:

a first ring of said sensor elements located from said central point, said elements having Cartesian coordinate locations wherein angles are expressed in degrees defined as:

| | |
|---|---|
| $Px(1,1) = a1(\cos(0))$ | $Py(1,1) = a1 (\sin(0))$ |
| $Px(1,2) = a1(\cos(20))$ | $Py(1,2) = a1 (\sin(20))$ |
| $Px(1,3) = a1(\cos(40))$ | $Py(1,3) = a1 (\sin(40))$ |
| . | . |
| . | . |
| . | . |
| $Px(1,n) = a1(\cos(20n))$ | $Py(1,n) = a1 (\sin(20(n - 1)))$ |

where $a1 = \alpha (1 + 2 \cos(20))$ and
$n = 1, 2, 3, \ldots 18$;

a second ring of said sensor elements from said central point, said elements having Cartesian coordinate locations wherein angles are expressed in degrees defined as:

| | |
|---|---|
| $Px(2,1) = a1 \cos(0) + \alpha \cos(40)$ | $Py(2,1) = a1 \sin(0) + \alpha \sin(40)$ |
| $Px(2,2) = a1 \cos(20) + \alpha \cos(60)$ | $Py(2,2) = a1 \sin(20) + \alpha \sin(60)$ |
| $Px(2,3) = a1 \cos(40) + \alpha \cos(80)$ | $Py(2,3) = a1 \sin(40) + \alpha \sin(80)$ |
| $Px(2,n) = a1 \cos(20(n - 1)) + \alpha \cos(20(n + 1))$ | $Py(2,n) = a1 (\sin(20(n - 1)) + \alpha \sin(20(n + 1))$ |

where $n = 1, 2, 3, \ldots 18$; and
a third ring of said sensor elements from said central point, said elements having Cartesian coordinate locations wherein angles are expressed in degrees defined as:

| | |
|---|---|
| $Px(3,1) = a1 \cos(0) + \alpha \cos(40) + \alpha \cos(60)$ | $Py(3,1) = a1 \sin(0) + \alpha \sin(40) + \alpha \sin(60)$ |
| $Px(3,2) = a1 \cos(20) + \alpha \cos(60) + \alpha \cos(80)$ | $Py(3,2) = a1 \sin(20) + \alpha \sin(60) + \alpha \sin(80)$ |
| $Px(3,3) = a1 \cos(40) + \alpha \cos(80) + \alpha \cos(100)$ | $Py(3,3) = a1 \sin(40) + \alpha \sin(80) + \alpha \sin(100)$ |
| . | . |
| . | . |
| . | . |
| $Px(3,n) = a1 \cos(20(n - 1)) + \alpha \cos(20(n + 1)) + \alpha \cos(20(n + 2))$ | $Py(3,n) = a1 \sin(20(n - 1)) + \alpha \sin(20(n + 1)) + \alpha \sin(20(n + 2))$ |

where $n = 1, 2, 3, \ldots 18$; and
where Px(R,S) is an "x" Cartesian coordinate and
Py(R,S) is a "y" Cartesian coordinate and
S is a sensor number corresponding to a sensor ring R.

where n=1,2,3, . . . 18 and where Px(R,S) is an "x" Cartesian coordinate and Py(R,S) is a "y" Cartesian coordinate and S is a sensor number corresponding to a sensor ring R.

10. An apparatus according to claim 9 wherein said sensor elements are antenna elements.

11. An apparatus according to claim 9 wherein said sensor elements are transponders.

12. An apparatus according to claim 9 including additional rings of said sensor elements from said central point, said elements of said additional rings of said elements having Cartesian coordinate locations wherein angles are expressed in degrees defined as:

$$Px(i,j,1,n) = Px(1,n) + i\, ux(n) + j\, vx(n)$$
$$Py(i,j,1,n) = Py(1,n) + i\, uy(n) + j\, vy(n)$$

where $i = 1, 2, 3, 4, 5, \ldots$ and
$j = 0, 1, 2, \ldots (i - 1)$ $$Px(i,j,2,n) = Px(2,n) + i\, ux(n) + j\, vx(n)$$
$$Py(i,j,2,n) = Py(2,n) + i\, uy(n) + j\, vy(n)$$

where $i = 1, 2, 3, 4, 5, \ldots$ and
$j = 0, 1, 2, \ldots i$ $$Px(i,j,3,n) = Px(3,n) + i\, ux(n) + j\, vx(n)$$
$$Py(i,j,3,n) = Py(3,n) + i\, uy(n) + j\, vy(n)$$

where $i = 1, 2, 3, 4, 5, \ldots$ and

-continued $j = 0, 1, 2, \ldots i$ also where $ux(n) = \alpha \cos(20(n+1)) + \alpha \cos(20(n+2)) + \alpha \cos(20(n+3))$ $uy(n) = \alpha \cos(20(n+1)) + \alpha \cos(20(n+2)) + \alpha \cos(20(n+3))$ $vx(n) = \alpha \cos(20(n+7))$ $vy(n) = \alpha \sin(20(n+7))$.

13. An apparatus according to claim 9 wherein said planar annular configuration of elements define a centrally located open center and wherein a planar core configuration of sensor elements is disposed within said centrally located center of said planar annular configuration of sensor elements and is made co-planar therewith and further wherein said sensor elements are separated by a distance "a" from nearest neighbor sensor elements and are located with respect to a central point, including a core first sensor element located at said central point;

a core first ring of six of said sensor elements located from said central point, said elements having Cartesian coordinate locations wherein angles are expressed in degrees defined as:

| | |
|---|---|
| $Px(1,1) = \alpha \cos(0) = \alpha$ | $Py(1,1) = 0 \sin(0) = 0$ |
| $Px(1,2) = \alpha \cos(60)$ | $Py(1,2) = \alpha \sin(60)$ |
| $Px(1,3) = \alpha \cos(120)$ | $Py(1,3) = \alpha \sin(120)$ |
| $Px(1,4) = \alpha \cos(180) = -\alpha$ | $Py(1,4) = \alpha \sin(180) = 0$ |
| $Px(1,5) = \alpha \cos(240)$ | $Py(1,5) = \alpha \sin(240)$ |
| $Px(1,6) = \alpha \cos(300)$ | $Py(1,6) = \alpha \sin(300)$; |

a core second ring of six of said sensor elements from said central point, said elements having Cartesian coordinate locations wherein angles are expressed in degrees defined as:

| | |
|---|---|
| $Px(2,1) = \alpha (\cos(0) + \cos(40))$ | $Py(2,1) = \alpha (\sin(0) - \sin(40))$ |
| $Px(2,2) = \alpha (\cos(60) + \cos(20))$ | $Py(2,2) = \alpha (\sin(60) + \sin(20))$ |
| $Px(2,3) = \alpha (\cos(120) + \cos(80))$ | $Py(2,3) = \alpha (\sin(120) + \sin(80))$ |
| $Px(2,4) = \alpha (\cos(180) + \cos(140))$ | $Py(2,4) = \alpha (\sin(180) + \sin(140))$ |
| $Px(2,5) = \alpha (\cos(240) + \cos(200))$ | $Py(2,5) = \alpha (\sin(240) + \sin(200))$ |
| $Py(2,6) = \alpha (\cos(300) + \cos(260))$ | $Py(2,6) = \alpha (\sin(300) + \sin(260))$; |

and a core third ring of six of said sensor elements from said central point, said elements having Cartesian coordinate locations wherein angles are expressed in degrees defined as:

| | |
|---|---|
| $Px(3,1) = \alpha (\cos(0) + \cos(20))$ | $Py(3,1) = \alpha (\sin(0) + \sin(20))$ |
| $Px(3,2) = \alpha (\cos(60) + \cos(80))$ | $Py(3,2) = \alpha (\sin(60) + \sin(80))$ |
| $Px(3,3) = \alpha (\cos(120) + \cos(140))$ | $Py(3,3) = \alpha (\sin(120) + \sin(140))$ |
| $Px(3,4) = \alpha (\cos(180) + \cos(200))$ | $Py(3,4) = \alpha (\sin(180) + \sin(200))$ |
| $Px(3,5) = \alpha (\cos(240) + \cos(260))$ | $Py(3,5) = \alpha (\sin(240) + \sin(260))$ |
| $Py(3,6) = \alpha (\cos(300) + \cos(320))$ | $Py(3,6) = \alpha (\sin(300) + \sin(320))$, |

wherein Px(R,S) is an "x" Cartesian coordinate and Py(R,S) is a "y" Cartesian coordinate and S is a sensor number corresponding to a sensor ring R of said core configuration of sensor elements.

14. An apparatus according to claim 13 wherein all of said sensor elements are antenna elements.

15. An apparatus according to claim 13 wherein all of said sensor elements are transponders.

* * * * *